US007539446B2

(12) United States Patent
Deguchi

(10) Patent No.: US 7,539,446 B2
(45) Date of Patent: May 26, 2009

(54) PROCESS CARTRIDGE AND IMAGE FORMING APPARATUS WITH FLEXIBLE GUIDE MEMBERS

(75) Inventor: Hideaki Deguchi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 256 days.

(21) Appl. No.: 11/340,539

(22) Filed: Jan. 27, 2006

(65) Prior Publication Data

US 2006/0171760 A1 Aug. 3, 2006

(30) Foreign Application Priority Data

Jan. 28, 2005 (JP) ..... 2005-021992
Jan. 28, 2005 (JP) ..... 2005-021993

(51) Int. Cl.
*G03G 15/16* (2006.01)

(52) U.S. Cl. ..... 399/316; 399/317

(58) Field of Classification Search ..... 399/316, 399/317

See application file for complete search history.

(56) References Cited

U.S. PATENT DOCUMENTS 4,882,606 A 11/1989 Deguchi
5,144,383 A 9/1992 Murano et al.
5,155,539 A 10/1992 Yamaguchi et al.
5,220,396 A 6/1993 Monma et al.
5,592,278 A 1/1997 Sato et al.
2005/0069343 A1 * 3/2005 Deguchi et al. ..... 399/111
2007/0269242 A1 11/2007 Hattori et al.
2007/0269243 A1 11/2007 Uehara et al.
2007/0269244 A1 11/2007 Miwa et al.

FOREIGN PATENT DOCUMENTS

CN 1073534 A 6/1993
EP 0549 089 A1 6/1993
EP 1 031 891 A 8/2000
JP 59206846 A * 11/1984

(Continued)

OTHER PUBLICATIONS

Chinese Office Action, with English Translation, issued in Chinese Patent Application No. CN 2006100071765, mailed Jun. 27, 2008.

*Primary Examiner*—David M Gray
*Assistant Examiner*—Ryan D Walsh
(74) *Attorney, Agent, or Firm*—McDermott Will & Emery LLP

(57) ABSTRACT

A first guide member and a second guide member, which are flexible, are disposed at an upstream side of a transfer position. The first guide member is fixed at a first base end at an upstream side of a first leading end so that the first leading end is closer to a photosensitive drum at the upstream side of the transfer position. The second guide member is fixed at a second base end at an upstream side of a second leading end so that the second leading end is closer to the photosensitive drum between the first leading end and the transfer position. A first plane connecting the first leading end and the first base end and a second plane connecting the second leading end and the second base end, are made to cross each other at an upstream side of the first base end.

39 Claims, 28 Drawing Sheets

FOREIGN PATENT DOCUMENTS

| | | | |
|---|---|---|---|
| JP | 63-43473 | U | 3/1988 |
| JP | 2-136269 | U | 11/1990 |
| JP | 7-160129 | | 6/1995 |
| JP | 7-181815 | | 7/1995 |
| JP | 8-36313 | A | 2/1996 |
| JP | 11-338279 | A | 12/1999 |
| JP | 2002-072204 | | 3/2002 |
| JP | 2003-5535 | | 1/2003 |

* cited by examiner

PROCESS CARTRIDGE AND IMAGE FORMING APPARATUS WITH FLEXIBLE GUIDE MEMBERS

CROSS REFERENCE TO RELATED APPLICATION

This application claims priority from two Japanese Patent Applications No. 2005-021992 and No. 2005-021993, both filed on Jan. 28, 2005, the entire subject matters of which are incorporated herein by reference.

TECHNICAL FIELD

The present invention may relate to an image forming apparatus such as a laser printer or the like, and a process cartridge included in the image forming apparatus.

BACKGROUND

Typically, a process unit having a photosensitive drum where a toner image is borne by development of electrostatic latent image is removably mounted in an image forming apparatus such as a laser printer. The photosensitive drum is disposed to be in contact with and to oppose to a transfer roller, and transfers a toner image onto a sheet while the sheet passes between the photosensitive drum and the transfer roller, so that the image is formed on the sheet.

However, when a gap occurs between the sheet and the photosensitive drum in an upstream side of a sheet conveying direction with respect to a transfer position where the photosensitive drum and the transfer roller are in contact with each other, discharge may occur in the gap. When such discharge occurs, particularly in a case of thin sheet, a discharge shape like a spot is shown, which is called a penetration which penetrates the sheet.

Accordingly, it has been proposed that a guide member for guiding a front end of the sheet to be closer to a surface of the photosensitive drum be mounted in the upstream side of the sheet conveying direction with respect to the transfer position.

FIGS. 31A-32C show the sheet transport states in the conventional process cartridge 90 in a stepwise manner. In this process cartridge 90, a photosensitive drum 91, and a transfer roller 92 in contact with and opposed to the photosensitive drum 91 are held by a case 93. A guide member 95 is installed in the case 93 for guiding the sheet 94 to the transfer position where the photosensitive drum 91 and the transfer roller 92 are in contact with each other.

A base end 96 (i.e., an end of the upstream side of the conveying direction of the sheet 94, which will be used with the same meaning in the following description) of the guide member 95 is fixed to the case 93 such that the guide member 95 is inclined upward toward the downstream from the upstream side of the conveying direction of the sheet 94 (Hereinafter, the downstream or upstream side of the conveying direction of the sheet 94 will be referred to as a simply downstream or upstream in some cases). A leading end 97 (i.e., an end of the downstream side of the conveying direction of the sheet 94, which will be used with the same meaning in the following description) of the guide member 95 is closely disposed to the photosensitive drum 91 in the upstream with respect to the transfer position.

As shown in FIGS. 31A and 31B, when the sheet 94 is transported to the process cartridge 90, the front end of the sheet 94 is guided toward the downstream along a top surface of the guide member 95 to reach the leading end 97 from the base end 96 of the guide member 95, and then guided to be in contact with the upstream side of the transfer position in the photosensitive drum 91.

The sheet 94 is then closely adhered to the photosensitive drum 91 in the upstream side of the transfer position from its front end and is guided to a location near its rear end while being in closely adhered to the photosensitive drum 91 as shown in FIG. 32A. Accordingly, the sheet 94 does not allow the gap to occur between the sheet and the photosensitive drum 91 in the upstream side of the transfer position, which thus suppresses the discharge from occurring therebetween. As a result, the discharge having a spot shape may be prevented from occurring in the sheet 94.

However, in accordance with this guide member 95, when the rear end of the sheet 94 passes the leading end 97 of the guide member 95, the rear end of the sheet 94 falls downward from the leading end 97 of the guide member 95 to be guided to the transfer position as shown in FIGS. 32B and 32C. Accordingly, the rear end of the sheet 94 is fluctuated to cause a transfer defect in the rear end.

Accordingly, it has been proposed that first and second guide members formed of polyester film having the same thickness be disposed in parallel with each other in the upstream side of the conveying direction of a transfer sheet with respect to an image carrier (e.g., see JP-A-8-036313). According to this proposal, a rear end of the transfer sheet which has passed the first guide member is guided to the image carrier by the second guide member disposed near the transfer position. As a result, the transfer defects in the rear end of the transfer sheet are reduced.

However, a thin sheet such as a weak plain sheet is apt to be discharged, so that it needs to be closely adhered to the photosensitive drum in the upstream side of the transfer position to prevent such discharge as described above. In the meantime, a thick sheet such as a strong postcard is not apt to be discharged as compared to the thin sheet, and needs to be correctly transported as much as possible because it causes bending when the thick sheet is closely adhered to the photosensitive drum as described above.

However, according to the configuration disclosed in JP-A-8-036313, the second guide member is disposed in parallel with the first guide member, so that the transfer sheet which has passed the first guide member is in contact with the second guide member disposed at the same inclination angle as the first guide member at a big angle. In this case, a resistant force of the second guide member against the transfer sheet increases so that the transfer sheet is strongly pressed toward the image carrier by the second guide member. Accordingly, in a case of such thick sheet, the transfer sheet is bent by the pressing to cause the transfer defect.

In addition, according to the configuration disclosed in JP-A-8-036313, since a second guide member is provided parallel to a first guide member, a transfer sheet passing through the first guide member contacts the second guide member, which is provided separately from the first guide member and is inclined in the same direction as that of the first guide member, from the same direction as the inclined direction.

In this case, the transfer sheet is pressurized by the second guide member from a direction approaching an image carrier toward an upstream side of a conveying direction of a transfer medium. Thus, a thick transfer sheet is bent due to the pressurization, leading to a transfer failure.

SUMMARY

One aspect of the present invention may provide a process cartridge and an image forming apparatus, which are capable of preventing transfer defects in any cases of a thin transfer medium and a thick transfer medium.

Another aspect of the present invention may provide a process cartridge and an image forming apparatus that can prevent a transfer failure by smoothly guiding a thin or thick transfer medium to a transfer position.

A process cartridge includes: an image carrier that carries a developer image that is transferred to a transfer medium at a transfer position; a first guide member that is provided with a first guide face that guides the transfer medium toward the image carrier, the first guide face having flexibility; and a second guide member that is provided with a second guide face that guides the transfer medium toward the image carrier, the second guide face having flexibility. The first guide face has a first base end that is fixed on an upstream side of a conveying direction of the transfer medium with respect to the transfer position, and a first leading end that extends toward the image carrier at the upstream side with respect to the transfer position. The second guide face has a second base end that is fixed on the upstream side with respect to the transfer position, and a second leading end that extends from the second base end toward the image carrier at between the first leading end and the transfer position. The second guide member is disposed so that a first plane connecting the first leading end and the first base end and a second plane connecting the second leading end and the second base end cross each other at the first base end or at the upstream side with respect to the first base end.

An image forming apparatus includes: an image carrier that carries a developer image that is transferred to a transfer medium at a transfer position; a developing unit that carries a developer, supplies the developer to the image carrier, and forms the developer image on the image carrier; a transfer unit that contacts with the image carrier at the transfer position, and transfers the developer image to the transfer medium; a conveying unit that conveys the transfer medium toward the transfer position; a first guide member that is provided with a first guide face that guides the transfer medium toward the image carrier, the first guide face having flexibility; and a second guide member that is provided with a second guide face that guides the transfer medium toward the image carrier, the second guide face having flexibility. The first guide face has a first base end that is fixed on an upstream side of a conveying direction of the transfer medium with respect to the transfer position, and a first leading end that extends toward the image carrier at the upstream side with respect to the transfer position. The second guide face has a second base end that is fixed on the upstream side with respect to the transfer position, and a second leading end that extends from the second base end toward the image carrier at between the first leading end and the transfer position. The second guide member is disposed so that a first plane connecting the first leading end and the first base end and a second plane connecting the second leading end and the second base end cross each other at the first base end or at the upstream side with respect to the first base end.

A process cartridge includes: an image carrier that carries a developer image that is transferred to a transfer medium at a transfer position; a first guide member that is provided with a first guide face that guides the transfer medium toward the image carrier, the first guide face having flexibility; and a second guide member that is provided with a second guide face that guides the transfer medium toward the image carrier, the second guide face having flexibility. The first guide face has a first base end that is fixed on an upstream side of a conveying direction of the transfer medium with respect to the transfer position, and a first leading end that extends toward the image carrier at the upstream side with respect to the transfer position. The second guide face has a second base end that is fixed on the upstream side with respect to the transfer position, and a second leading end that extends from the second base end toward upstream side to oppose the first leading end.

An image forming apparatus includes: an image carrier that carries a developer image that is transferred to a transfer medium at a transfer position; a developing unit that carries a developer, supplies the developer to the image carrier, and forms the developer image on the image carrier; a transfer unit that contacts with the image carrier at the transfer position, and transfers the developer image to the transfer medium; a conveying unit that conveys the transfer medium toward the transfer position; a first guide member that is provided with a first guide face that guides the transfer medium toward the image carrier, the first guide face having flexibility; and a second guide member that is provided with a second guide face that guides the transfer medium toward the image carrier, the second guide face having flexibility. The first guide face has a first base end that is fixed on an upstream side of a conveying direction of the transfer medium with respect to the transfer position, and a first leading end that extends toward the image carrier at the upstream side with respect to the transfer position. The second guide face has a second base end that is fixed on the upstream side with respect to the transfer position, and a second leading end that extends from the second base end toward upstream side to oppose the first leading end.

BRIEF DESCRIPTION OF THE DRAWINGS

In the accompanying drawings:

FIGS. 3A and 3B are schematic plan views illustrating the first and second guide members, wherein FIG. 3A shows that the first and second guide members are continuously arranged in their width direction, and wherein FIG. 3B shows that the first and second guide members are divided in their width direction;

FIGS. 4A and 4B are side cross-sectional views schematically illustrating an operation of guiding a thin sheet to a transfer position in a stepwise manner, wherein FIG. 4A shows that the front end of the thin sheet has reached the first leading end of the first guide face, and wherein FIG. 4B shows that the front end of the thin sheet is closely adhered to the photosensitive drum;

FIGS. 5A-5C are side cross-sectional views schematically illustrating an operation of guiding a thin sheet to a transfer position in a stepwise manner, wherein FIG. 5A shows that the rear end of the thin sheet is closely adhered to the photosensitive drum, wherein FIG. 5B shows that the rear end of the thin sheet is elastically received by the second leading end of the second guide face, and wherein FIG. 5C shows that the rear end of the thin sheet is guided to the transfer position;

FIGS. 6A and 6B are side cross-sectional views schematically illustrating an operation of guiding a thick sheet to a transfer position in a stepwise manner, wherein FIG. 6A shows that the front end of the thick sheet has reached the first leading end of the first guide face, and wherein FIG. 6B shows that the front end of the thick sheet is in contact with the photosensitive drum;

FIGS. 7A and 7B are side cross-sectional views schematically illustrating an operation of guiding a thick sheet to a transfer position in a stepwise manner, wherein FIG. 7A shows that the rear end of the thick sheet is in contact with the photosensitive drum, and wherein FIG. 7B shows that the rear end of the thick sheet is guided to the transfer position;

FIGS. 11A-11D are schematic plan views illustrating different structures (i.e. shapes of the slit) of the first and second guide members, wherein FIG. 11A shows that the slit is substantially rectangular when seen its plan view, wherein FIG. 11B shows that the slit substantially has a V-shape when seen its plan view, wherein FIG. 11C shows that the slit substantially has a U-shape, and wherein FIG. 11D shows that the separation stopper is formed in the end of the slit substantially having the V-shape when seen its plan view;

FIGS. 15A and 15B are plan views of a first guide member and a second guide member, wherein FIG. 15A illustrates the first and second guide members that are continuously formed with each other in a width direction, and wherein FIG. 15B shows the first and second guide members that are divided in a width direction;

FIGS. 16A and 16B are side sectional views showing operation of guiding a thin sheet to a transfer position step by step by means of the first and second guide members, wherein FIG. 16A illustrates a front end part of the thin sheet that has reached a first leading end of a first guide face, and wherein 16B illustrates the front end part of the thin sheet that is closely in contact with a photosensitive drum.

FIGS. 17A-17C are side sectional views showing operation of guiding a thin sheet to a transfer position step by step by means of the first and second guide members, wherein FIG. 17A illustrates a rear end part of the thin sheet that is closely in contact with a photosensitive drum, wherein FIG. 17B illustrates the rear end part of the thin sheet that is elastically received by a second leading end of a second guide face, and wherein FIG. 17C illustrates the rear end part of the thin sheet that is guided to a transfer position;

FIGS. 18A and 18B are side sectional views showing operation of guiding a thick sheet to a transfer position step by step by means of the first and second guide members, wherein FIG. 18A illustrates a front end part of the thick sheet that has reached a first leading end of a first guide face, and wherein FIG. 18B illustrates the front end part of the thick sheet that is closely in contact with a photosensitive drum;

FIGS. 19A and 19B are side sectional views showing operation of guiding a thick sheet to a transfer position step by step by means of the first and second guide members, wherein FIG. 19A illustrates a rear end part of the thick sheet that is closely in contact with a photosensitive drum, and wherein FIG. 19B illustrates the rear end part of the thick sheet that is guided to a transfer position;

FIGS. 23A-23D are schematic plan views illustrating different structures (i.e. shapes of the slit) of the first and second guide members, wherein FIG. 23A shows that the slit is substantially rectangular when seen its plan view, wherein FIG. 23B shows that the slit substantially has a V-shape when seen its plan view, wherein FIG. 23C shows that the slit substantially has a U-shape, and wherein FIG. 23D shows that the separation stopper is formed in the end of the slit substantially having the V-shape when seen its plan view;

FIGS. 26A and 26B are side sectional views showing operation of guiding a thin paper to a transfer position step by step by means of the first and second guide members shown in FIG. 25, wherein FIG. 26A illustrates a front end part of the thin paper that has reached a first leading end of a first guide face, and wherein FIG. 26B illustrates the front end part of the thin paper that is closely in contact with a photosensitive drum;

FIGS. 27A-27C are side sectional views showing operation of guiding a thin paper to a transfer position step by step by means of the first and second guide members shown in FIG. 25, wherein FIG. 27A illustrates a rear end part of the thin paper that is closely in contact with a photosensitive drum, wherein FIG. 27B illustrates the rear end part of the thin paper that is elastically received by a second leading end of a second guide face, and wherein 27C illustrates the rear end part of the thin paper that is guided to a transfer position;

FIGS. 28A and 28B are side sectional views showing operation of guiding a thick paper to a transfer position step by step by means of the first and second guide members shown in FIG. 25, wherein FIG. 28A illustrates a front end part of the thick paper that has reached a first leading end of a first guide face, and wherein FIG. 28B illustrates the front end part of the thick paper that is closely in contact with a photosensitive drum;

FIGS. 29A-29C are side sectional views showing operation of guiding a thick paper to a transfer position step by step by means of the first and second guide members shown in FIG. 25, wherein FIG. 29A illustrates a rear end part of the thick paper that is closely in contact with a photosensitive drum, wherein FIG. 29B illustrates the rear end part of the thick paper that is elastically received by a second leading end of a second guide face, and wherein FIG. 29C illustrates the rear end part of the thick paper that is guided to a transfer position;

FIGS. 31A and 31B are side cross-sectional views schematically illustrating states of carrying the paper in a conventional process cartridge in a stepwise manner, wherein FIG. 31A shows that the front end of the paper has reached the leading end of the guide member, and wherein FIG. 31B shows that the front end of the paper is closely adhered to the photosensitive drum; and FIGS. 32A-32C are side cross-sectional views schematically illustrating states of carrying the paper in the conventional process cartridge in a stepwise manner, wherein FIG. 32A shows that the rear end of the paper is closely adhered to the photosensitive drum, wherein FIG. 32B shows that the rear end of the paper falls downward from the leading end of the guide member, and wherein FIG. 32C shows that the rear end of the paper is guided to the transfer position.

DETAILED DESCRIPTION

Illustrative aspects of the present invention will be described hereinbelow by reference to the drawings.

First Illustrative Aspect

Total structure of the laser printer

Figure 1:
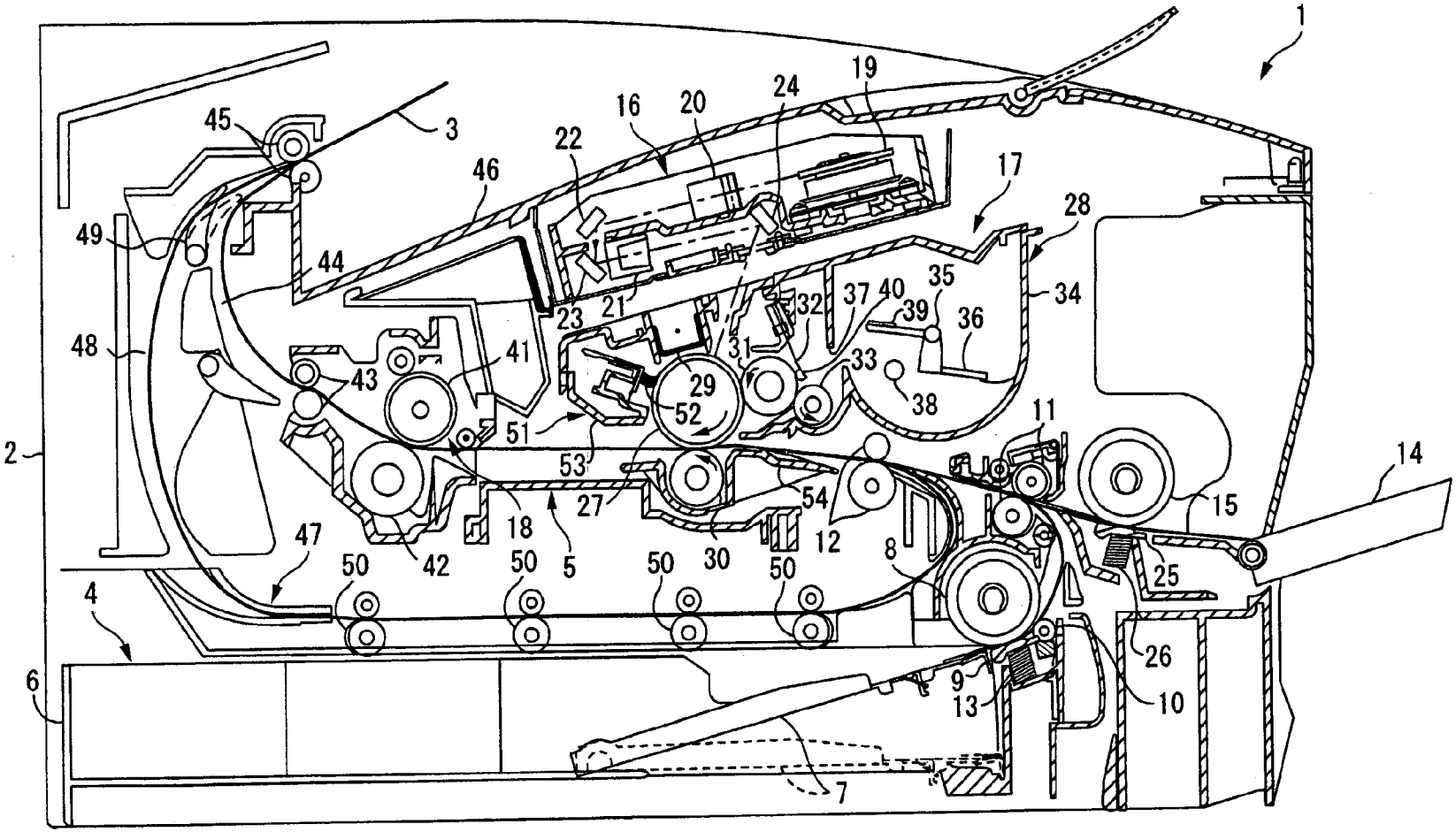
FIG. 1 is a side cross-sectional view illustrating a laser printer as the image forming apparatus according to a first illustrative aspect.

FIG. 1 is a side cross-sectional view illustrating a first illustrative aspect of the laser printer as the image forming apparatus.

Referring to FIG. 1, the laser printer 1 includes a feeder 4 for feeding a sheet 3 as a transfer medium, and an image forming unit 5 for forming an image on the fed sheet 3 in a main body case 2.

Structure of the Feeder

The feeder 4 has, a feed tray 6 that is removably mounted on a bottom within the main body case 2, a sheet pressing plate 7 disposed in the feed tray 6, a feed roller 8 and a feed pad 9 disposed above one end of the feed tray 6 as a conveying unit, sheet dust removal rollers 10 and 11 disposed in the downstream (hereinafter, the downstream or upstream side of the conveying direction of the sheet 3 will be referred to as a simply downstream or upstream in some cases) of the conveying direction of the sheet 3 with respect to the feed roller 8, and a resist roller 12 disposed in the downstream with respect to the sheet dust removal rollers 10 and 11.

The sheet pressing plate 7 may have the sheets 3 stacked, and its far end with respect to the feed roller 8 is flexibly supported and its near end with respect to the feed roller 8 is movable in up and down directions, and a force is applied upward from its rear surface by a spring (not shown). Accordingly, when an amount of the stacked sheets 3 increases, the sheet pressing plate 7 is fluctuated using the far end with respect to the feed roller 8 as a bearing downward while resisting against the pressing force of the spring. The feed roller 8 and the feed pad 9 are opposed to each other, and the feed pad 9 is pressed toward the feed roller 8 by the spring 13 disposed at the rear surface of the feed pad 9.

The sheet 3 on a top surface of the sheet pressing plate 7 is pressed toward the feed roller 8 by a spring (not shown) from a rear surface of the sheet pressing plate 7, and is fit between the feed roller 8 and the feed pad 9 by the rotation of the feed roller 8 and then fed on one sheet basis.

Sheet dusts of the fed sheet 3 are removed by the sheet dust removal rollers 10 and 11, and the fed sheet is then transported to the resist roller 12. The resist roller 12 is composed of a pair of rollers opposite to each other, and makes the sheet 3 subject to the resist and then moved to an image formation location. In addition, the image formation location is a transfer position where the toner image on the photosensitive drum 27 is transferred to the sheet 3, and is a location where the photosensitive drum 27 and the transfer roller 30 are in contact with each other in the present illustrative aspect.

The feeder 4 includes a multi-purpose tray 14, a multi-purpose feed roller 15 and a multi-purpose feed pad 25 for feeding the sheet 3 to be stacked on the multi-purpose tray 14. The multi-purpose feed roller 15 and the multi-purpose feed pad 25 are disposed to oppose to each other, and the multi-purpose feed pad 25 is pressed toward the multi-purpose feed roller 15 by the spring 26 disposed at a rear surface of the multi-purpose feed pad 25.

The sheet 3 to be stacked on the multi-purpose tray 14 is fit between the multi-purpose feed roller 15 and the multi-purpose feed pad 25 by rotation of the multi-purpose feed roller 15 and then fed on one sheet basis.

Structure of Image Forming Unit

The image forming unit 5 includes a scanner unit 16, a process cartridge 17, and a fixing unit 18.

Structure of the Scanner Unit

The scanner unit 16 is disposed at an upper location within the main body case 2, and includes a laser emitting unit (not shown), a polygon mirror 19 driven by rotation, lenses 20 and 21, reflectors 22, 23, and 24, and so forth. A laser beam on the basis of the image data emitted from the laser emitting unit, as shown in the chain line, passes or is reflected in an order of the polygon mirror 19, the lens 20, the reflectors 22 and 23, the lens 21, and the reflector 24, so that it is scanned at a fast speed on a surface of the photosensitive drum 27 of the process cartridge 17.

Structure of the Process Cartridge

The process cartridge 17 is disposed below the scanner unit 16, and includes a case 51 freely removable with respect to the main body case 2, and a developing cartridge 28, a photosensitive drum 27 as the image carrier, a scorotron type charger 29, a conductive brush 52, and a transfer roller 30 as the transfer unit are disposed in the case 51.

The case 51 has an upper case 53 and a lower case 54 with a path for the sheet 3 interposed therebetween. The photosensitive drum 27, the scorontron type charger 29, and the conductive brush 52 are received in the upper case 53, and the developing cartridge 28 is freely and removably mounted thereon. In addition, the transfer roller 30 is received in the lower case 54.

The developing cartridge 28 is freely and removably mounted with respect to the case 51, and has a developing roller 31 as the developing unit, a layer thickness restricting blade 32, a supply roller 33, and a toner hopper 34.

The toner hopper 34 has an inner space at one side of the case 51. A toner of positive static non-magnetic one component is received as a developer within the toner hopper 34. An example this toner may be one obtained by copolymerizing a copolymer monomer, such as, a styrene monomer like styrene, or an acrylic monomer like acrylic acid, alkyl (C1 to C4) acrylate, alkyl (C1 to C4) methacrylate using a well-known polymerization method such as suspension polymerization. Such polymerization toner is substantially spherical and has good fluidity. A colorant such as carbon black or wax is compounded into the toner, and an external additive such as silica is given for enhancing the fluidity. A particle diameter of the toner is about 6 to 10 μm.

The toner within the toner hopper 34 is stirred by an agitator 36 supported by the rotation axis 35 disposed at a center of the toner hopper 34, which is discharged from the toner supply 37 opened at a side portion of the other side of the toner hopper 34. In addition, a window 38 for detecting a remaining amount of toner is disposed on the side wall of the toner hopper 34, which is cleaned by the cleaner 39 supported by the rotation axis 35.

The supply roller 33 is rotatably disposed at a side portion of the other side of the toner supply 37, and the developing roller 31 opposing to the supply roller 33 is rotatably disposed. These supply roller 33 and the developing roller 31 are in contact with each other while pressing each other with a predetermined pressure.

The supply roller 33 is composed of a roller axis formed of metal and a roller covered with a conductive foaming material.

The developing roller 31 is composed of a roller axis formed of metal and a roller covered with a conductive rubber material. To detail this, the roller of the developing roller 31 has a surface formed of conductive urethane rubber or silicon rubber containing carbon fine particles and covered by a coating layer formed of urethane rubber or silicon rubber containing fluorine. In addition, a developing bias is applied to the developing roller 31 at the time of development.

The layer thickness restricting blade 32 is disposed near the developing roller 31. The layer thickness restricting blade 32 has a semicircular pressing unit 40 formed of insulating silicon rubber in the leading end of the blade composed of metal plate spring when seen its cross-sectional view, and is supported to the developing cartridge 28 near the developing roller 31, so that the pressing unit 40 is press welded on the developing roller 31 by the elastic force of the blade.

The toner discharged from the toner supply 37 is supplied to the developing roller 31 by rotation of the arrow direction (counterclockwise direction), and at this time, the toner is positively friction-charged between the supply roller 33 and the developing roller 31. The toner supplied onto the developing roller 31 is moved between the developing roller 31 and the pressing unit 40 of the layer thickness restricting blade 32 in response to the rotation of the developing roller 31 toward the arrow direction (counterclockwise direction), so that it is born on the developing roller 31 as a thin layer having a predetermined thickness.

The photosensitive drum 27 is rotatably supported in the arrow direction (clockwise direction) in the upper case 53 while it opposes to the developing roller 31 at the side location of the other side of the developing roller 31. This photosensitive drum 27 has its drum grounded while its surface portion is composed of a positive static photosensitive layer formed of polycarbonate.

The scorotron type charger 29 is disposed above the photosensitive drum 27 by a predetermined interval and opposes to the photosensitive drum 27, and is supported by the upper case 53. The scorotron type charger 29 is a positive static scorotron type charge of generating corona discharge from static wire such as tungsten, and is configured to charge the surface of the photosensitive drum 27 with a uniform positive polarity.

In addition, the conductive brush 52 is disposed to oppose to the photosensitive drum 27 in the side location (side location of the opposite side to the developing roller 31) of the other side of the photosensitive drum 27. This conductive brush 52 is fixed to the upper case 53 while in contact with the surface of the photosensitive drum 27.

The transfer roller 30 is disposed to oppose to and in contact with the photosensitive drum 27, and is rotatably supported in the arrow direction (counterclockwise direction) below the photosensitive drum 27. The transfer roller 30 is an ion conductive type transfer roller, and has a roller axis formed of metal which is covered by a roller formed of a conductive rubber material. A transfer bias is applied to the transfer roller 30 by constant current control at the time of transfer. In addition, a transfer position is formed at a contact position (nip location) between the transfer roller 30 and the photosensitive drum 27.

A surface of the photosensitive drum 27 is uniformly positive-charged by the scorotron type charger 29, and then exposed to the laser beam emitted from the scanner unit 16 by the fast speed scanning, so that an electrostatic latent image on the basis of the image data is formed.

Subsequently, when the toner positive-charged and borne on the developing roller 31 opposes to and is in contact with the photosensitive drum 27 by the rotation of the developing roller 31, the toner is supplied to the electrostatic latent image formed on the surface of the photosensitive drum 27, that is, the exposed portion exposed to the laser beam to have a reduced electric potential on the surface of the uniformly positive-charged photosensitive drum 27, which is thus selectively borne and visual, so that the toner image is formed as the image of the developer by the reverse development.

Subsequently, the photosensitive drum 27 and the transfer roller 30 are driven by rotation while maintaining the sheet 3 therebetween to be transported with respect to the transfer position, and the sheet 3 is transported between the photosensitive drum 27 and the transfer roller 30, so that the toner image borne on the surface of the photosensitive drum 27 is transferred to the sheet 3.

After the transfer, sheet dusts attached to the surface of the photosensitive drum 27 due to the contact with the sheet 3 are removed by the brush when the surface of the photosensitive drum 27 opposes to the brush of the conductive brush 52 in response to the rotation of the photosensitive drum 27.

The laser printer 1 employs a cleanerless manner for withdrawing the remaining toner on the surface of the photosensitive rum 27 using the developing roller 31 after the toner is transferred to the sheet 3 by the transfer roller 30. When such cleanerless configuration is employed to withdraw the toner remaining on the photosensitive drum 27, a toner cleaner unit or storage for waster toner is not necessary, so that the device structure may be simplified.

Structure of the Fixing Unit

The fixing unit 18 is disposed in the downstream side of the other side of the process cartridge 17, and has a heating roller 41, a pressing roller 42 opposing to the heating roller 41 and pressing the heating roller 41, and a pair of transport rollers 43 disposed in the downstream side of the heating roller 41 and the pressing roller 42.

The heating roller 41 has a halogen lamp formed of metal for heating, and thermally fixes the toner transferred to the sheet 3 while the sheet 3 passes between the heating roller 41 and the pressing roller 42 in the process cartridge 17, and then makes the sheet 3 transported to the delivery path 44 by means of the transfer roller 43. The sheet 3 sent to the delivery path 44 is sent to the delivery roller 45, which is then delivered onto the delivery tray 46 by the delivery roller 45.

Description of Duplex Printing Unit

A reverse conveying unit 47 as the duplex printing unit is disposed in the laser printer 1 for forming an image on the both sides of the sheet 3. The reverse conveying unit 47 has a delivery roller 45, a reverse transport path 48, a flapper 49, and a plurality of reverser transport rollers 50.

The delivery roller 45 is composed of a pair of rollers, and is configured to switch between normal rotation and reverser rotation. The delivery rollers 45 rotate in the normal direction when the sheet 3 is delivered on the delivery tray 46, but rotate in the reverse direction when the sheet 3 is reversed as described above.

The reverse transport path 48 is disposed along the up and down directions so that the sheet 3 may be transported from the delivery roller 45 to a plurality of reverse transport rollers 50 disposed below the image formation location, and its upstream end is disposed close to the delivery roller 45 while its downstream end is disposed close to the reverse transport roller 50.

The flapper 49 may fluctuate so as to reach the branch location between the reverse transport path 48 and the delivery path 44, and may switch the reversed conveying direction of the sheet 3 by the delivery roller 45 to the direction toward the reverse transport path 48 by means of excitation or non-excitation of a solenoid (not shown).

A plurality of reverse transport roller 50 are disposed in a substantially horizontal direction above the feed tray 6, and the reverse transport roller 50 at the highest upstream is disposed closer to the rear end of the reverse transport path 48 while the reverse transport roller 50 at the lowest upstream is disposed below the resist roller 12.

When the image is formed on both sides of the sheet 3, this reverse conveying unit 47 operates as follows. That is, when the sheet having the image formed on one surface is returned to the delivery rollers 45 from the delivery path 44 by the transport roller 43, the delivery rollers 45 normally-rotates while having the sheet 3 fit therebetween, and makes the sheet 3 transported toward an outside (the side of delivery tray 46), and most of the sheet 3 is sent to the outside, so that the normal rotation is stopped when the rear end of the sheet 3 is fit in the delivery rollers 45. Subsequently, the delivery roller 54 reverse-rotates while switching the conveying direction to allow the sheet 3 to be transported to the reverse transport path 48, so that the sheet 3 is transported to the reverser transport but 48 in a reverser direction before and after the switching. In addition, the flapper 49 may switch to the state of sending the sheet 3 transported from the transport roller 43 to the delivery roller 45 when the transport of the sheet 3 is terminated.

Subsequently, the sheet 3 reversely-transported to the reverse transport path 48 is transported to the reverser transport roller 50, and is reversed from the reverse transport roller 50 to be sent to the resist roller 12. The sheet 3 transported to the resist roller 12 in its flipped state is sent again toward the image formation location after a predetermined resist is carried out so that the image is formed on both sides of the sheet 3.

Structure of a Main Part of the Process Cartridge

Figure 2:
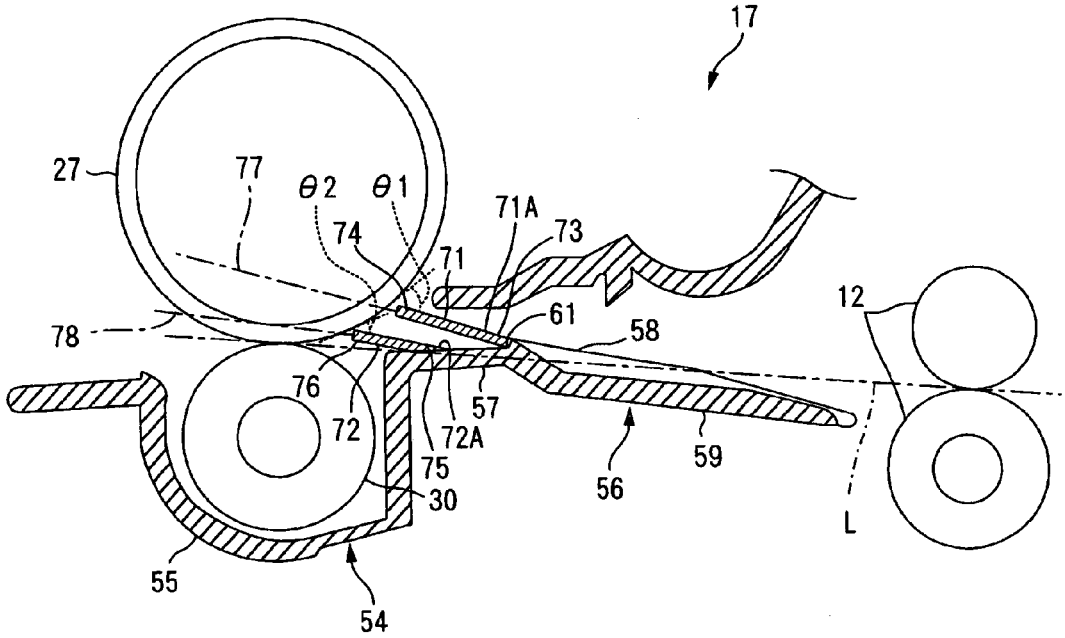
FIG. 2 is a side cross-sectional view illustrating a main part of the process cartridge of the laser printer shown in FIG. 1.

FIG. 2 is a side cross-sectional view illustrating a main part of the process cartridge 17 of the laser printer 1 shown in FIG. 1.

As shown in FIG. 2, the lower case 54 of the process cartridge 17 is integrally provided with, a transfer roller receiving unit 55 of receiving the transfer roller 30, and a sheet guide unit 56 disposed in the upstream side of the transfer roller receiving unit 55 and for guiding the sheet 3 toward the photosensitive drum 27 as one body.

The transfer roller receiving unit 55 has a concave shape when seen its cross-sectional view along the width direction orthogonal to the conveying direction of the sheet 3 (hereinafter, it will be simply referred to as a width direction), and the transfer roller 30 is received by the transfer roller receiving unit 55 having the concave shape, and is rotatably supported in the transfer roller receiving unit 55 while it is disposed below the photosensitive drum 27 to oppose to and in contact with the photosensitive drum 27.

A sheet guide unit 56 is shaped as a substantially flat plate which is inclined a little upward toward the front end (i.e., an end of the downstream side of the conveying direction of the sheet 3, which will be used with the same meaning in the following description) from the rear end (i.e., an end of the upstream side of the conveying direction of the sheet 3, which will be used with the same meaning in the following description), and is integrally provided with a maintaining unit 57 for storing the first guide member 71 and the second guide member 72 and an introducing unit 59 where the rib member 58 is disposed as one body.

The maintaining unit 57 is fixed to the transfer roller receiving unit 55, and its front end is continuous with a rear end of the transfer roller receiving unit 55, and its rear end is continuous with the front end of the introducing unit 59. A step unit 61 for maintaining the first guide member 71 is disposed in the rear end of the maintaining unit 57. The step unit 61 is formed as a step dented downward and having a substantially L-shape, and a height of the step is set to be same as or higher than a thickness of the first guide member 71 so that the sheet transported from the upstream is not stuck in the step.

The introducing unit 59 has its front end connected to the rear end of the maintaining unit 57, and has its rear end extended near the side of the resist roller 12 as shown in FIG. 2. A rib member 58 is disposed in the introducing unit 59. The rib member 58 is formed for reinforcing the lower case 54 and reducing the friction resistance at the time of carrying the sheet, and is shaped as a plate to stand in up and down directions in the introducing unit 59 along the conveying direction: of the sheet 3, and a plurality of the rib members are formed along the width direction of the sheet 3 by a predetermined interval from each other on the top surface of the introducing unit 59. In addition, the front end of each rib member 58 is disposed to the substantially same height as the height of the rear end of the step unit 61, that is, the higher surface between the higher surface having the step and the lower surface having the step.

The first guide member 71 and the second guide member 72 are supported by the maintaining unit 57 in the process cartridge 17.

The first guide member 71 and the second guide member 72 are formed of an insulating material having flexibility, for example, a resin like polyethylene-terephthalate, and are composed of a substantially rectangular film member formed by press working.

The first base end 73 as the rear end is fixed to the step surface of the step unit 61 of the maintaining unit 57 so that the first guide member 71 is inclined upward to the downstream from the upstream. The first guide member 71 extends toward the photosensitive drum 27 from its first base end 73, so that the top surface of the first guide member 71 constitutes the first guide face 71A for guiding the sheet 3 toward the photosensitive drum 27. The first leading end 74 as the front end of the first guide member 71 is disposed close to the photosensitive drum 27 above the front-end of the maintaining unit 57 in the upstream side of the transfer position. The first guide member 71 is formed to a thickness of 0.100 to 0.200 mm, and preferably 0.125 mm.

The second base end 75 as the rear end is fixed to the top surface of the front end of the maintaining unit 57 in the downstream than the first base end 73 of the first guide member 71 so that the second guide member 72 is inclined upward to the downstream from the upstream. The second guide member 72 extends toward the photosensitive drum 27 from its second base end 75, so that the top surface of the second guide member 72 constitutes the second guide face 72A for guiding the sheet 3 toward the photosensitive drum 27. The second leading end 76 as the front end of the second guide member 72 is disposed close to the photosensitive drum 27 between the transfer position and the first leading end 74 of the first guide member 71. The second guide member 72 is preferably formed to a thickness of 0.075 to 0.125 mm, and more preferably 0.100 mm.

When the surface at the side in contact with the cutting blade at the time of press working is a surface and a surface opposite to the surface is a rear surface in each of the first guide member 71 and the second guide member 72, the surface, that is, the sagged surface of the press working is disposed to the top surface (the first guide face 71A and the second guide face 72A) in contact with the sheet 3, and the rear surface is disposed to be the bottom surface opposing to the top surface of the maintaining unit 57.

The edge of the first leading end 74 of the first guide face 71A and the edge of the second leading end 76 of the second guide face 72A are disposed above the line L connecting contact position (transfer position) between the photosensitive drum 27 and the transfer roller 30 to the contact position between the two resist rollers 12 opposite to each other.

Figure 3A:
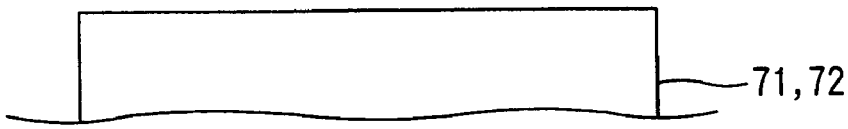

The first guide member 71 and the second guide member 72 may be disposed in the width direction orthogonal to the conveying direction of the sheet 3, that is, the direction in parallel with the axis direction of the photosensitive drum 27 as shown in FIG. 3A.

Figure 3B:
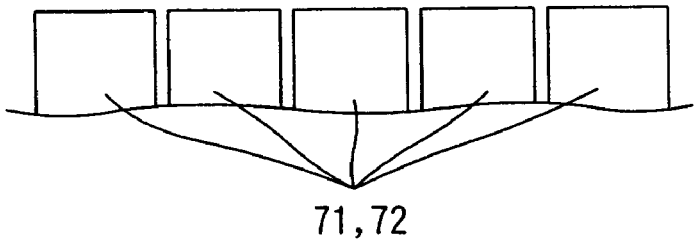

The first guide member 71 and the second guide member 72 may be divided to be disposed in parallel with each other by a predetermined interval in the direction orthogonal to the conveying direction of the sheet 3 as shown in FIG. 3B.

The first guide member 71 may use the bending of the first leading end 74 to set the contact position between the sheet 3 and the photosensitive drum 27, and is disposed in a location capable of guiding the sheet at the contact angle θ1 between the sheet 3 and the photosensitive drum 27 less than 90°. The second guide member 72 may use the bending of the second leading end 76 to set the contact position between the sheet 3 and the photosensitive drum 27, and is disposed in a location capable of guiding the sheet at the contact angle θ2 between the sheet 3 and the photosensitive drum 27 less than 90°. The inclined angles of the first guide member 71 and the second guide member 72 with respect to the maintaining unit 57 are set such that θ1 is larger than θ2.

The first guide member 71 is formed to have a product $E_1I_1$ between an expanding modulus of elasticity $E_1$ in a direction in parallel with the conveying direction of the sheet 3 and geometric moment of inertia $I_1$ in a direction in parallel with the longitudinal direction of the photosensitive drum 27 and vertical to the largest plane (top surface of bottom surface) of the first guide member 71 in a range of $3.49\times10^{-5}\leqq E_1I_1\leqq1.18\times10^{-3}$. And the second guide member 72 is formed to have a product $E_2I_2$ between an expanding modulus of elasticity $E_2$ in a direction in parallel with the conveying direction of the sheet 3 and geometric moment of inertia $I_2$ in a direction in parallel with the axis direction of the photosensitive drum 27 and vertical to the largest plane (top surface of bottom surface) of the second guide member 72 in a range of $3.49\times10^{-5}\leqq E_2I_2\leqq1.18\times10^{-3}$.

The length from the first leading end 74 to the first base end 73 of the first guide face 71A is longer than the length from the second leading end 76 to the second base end 75 of the second guide face 72A. In addition, the second leading end 76 of the second guide face 72A is disposed in the downstream than the projecting plane of the direction (downward) where the sheet guided by the first guide face 71A presses the first guide member 71. And the first guide member 71 is formed thicker than the second guide member 72 as described above, so that the geometric moment of inertia $I_1$ of the first guide member 71 is set to be greater than the geometric moment of inertia $I_2$ of the second guide member 72.

In this case, the method of setting the geometric moment of inertia $I_1$ of the first guide member 71 greater than the geometric moment of inertia $I_2$ of the second guide member 72, is not limited to the method of forming the first guide member 71 thicker than the second guide member 72 as described above, but may employ a method of forming a length of the width direction of the first guide member 71 longer than a length of the width direction of the second guide member 72.

Figure 5A:
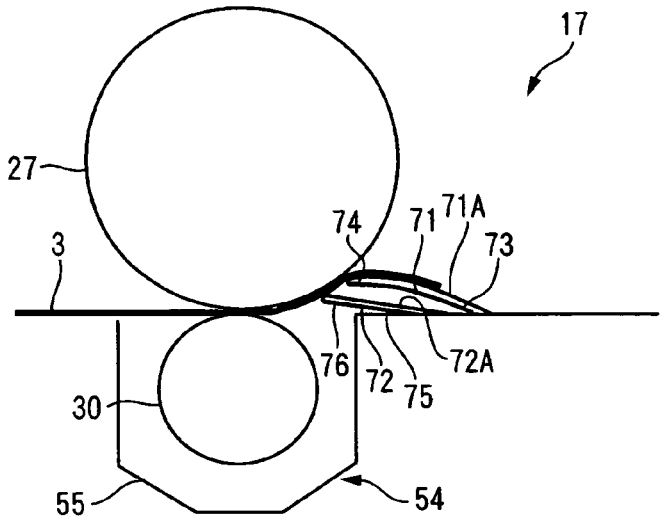
Figure 5B:
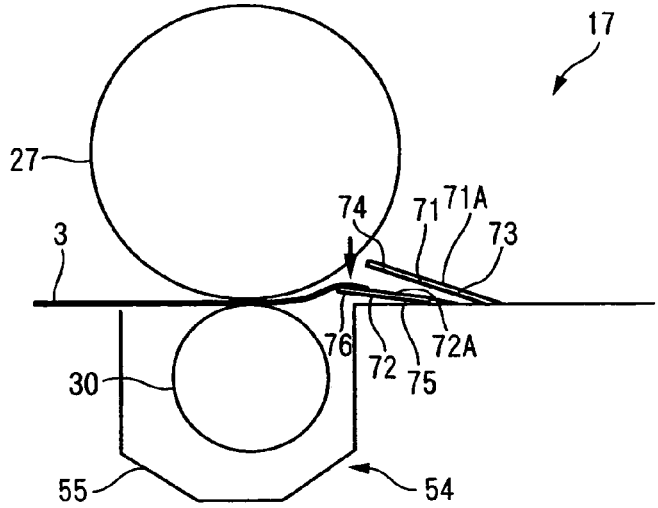
Figure 5C:
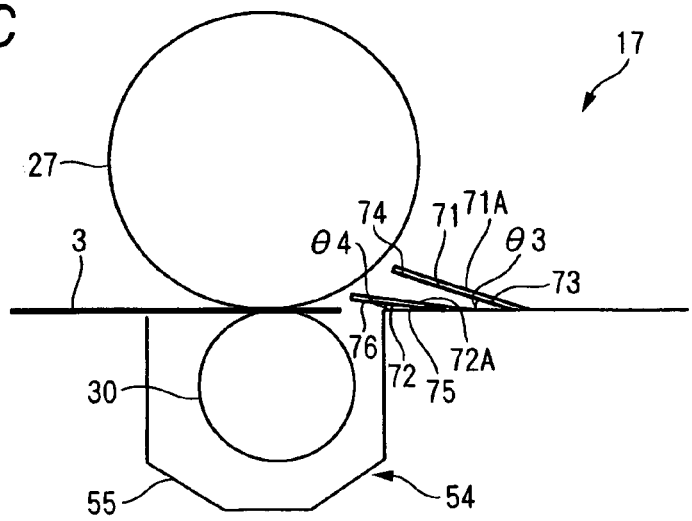

The inclined angle θ3 of the first guide member 71 with respect to the maintaining unit 57 is preferably 30° to 45°, and preferably about 30° (see FIG. 5C). The inclined angle θ4 of the second guide member 72 with respect to the maintaining unit 57 is preferably 10° to 40°, and preferably about 20° (see FIG. 5C). The inclined angle θ4 of the second guide member 72 with respect to the maintaining unit 57 is set to be smaller than the inclined angle θ3 of the first guide member 71 with respect to the maintaining unit 57, so that the plane 77 connecting the first leading end 74 to the first base end 73 of the first guide member 71 and the plane 78 connecting the second leading end 76 to the second base end 75 of the second guide member 72 cross each other in the upstream side of the first base end 73.

Next, operations of guiding the thin sheet 3 and the thick sheet 3 to the transfer position in the process cartridge 17 will be described in detail. In addition, when a weight per square meter of the sheet 3 (plain sheet) is 75 to 105 g/m$^2$ in the present illustrative aspect, such plain sheet or a sheet (e.g., tracing sheet) having the weight of 56 to 75 g/m$^2$ is referred to the thin sheet, and a sheet (e.g., postcard or the like) having the weight of 105 to 200 g/m$^2$ or more is referred to the thick sheet.

Description of an Operation Guiding a Thin Sheet to a Transfer Position

Figure 4A:
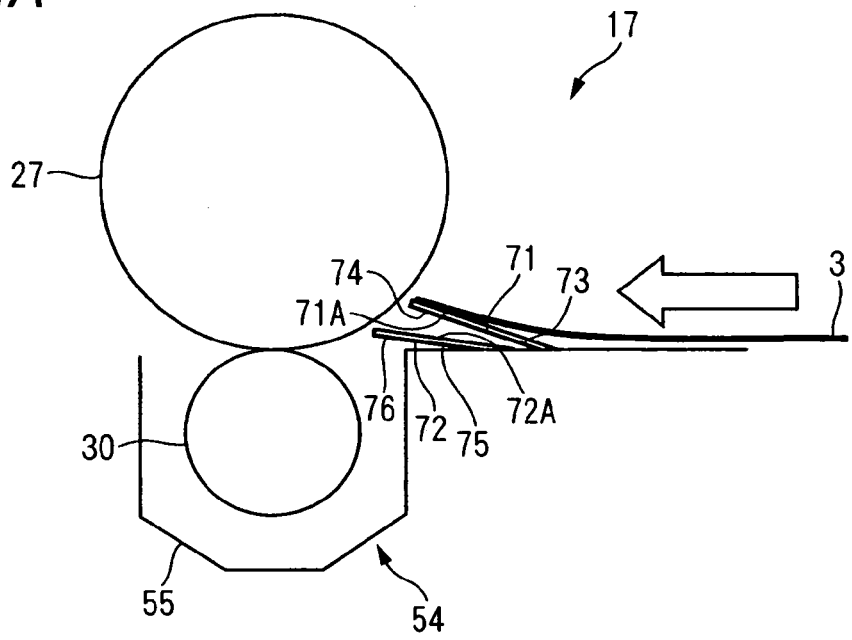

FIGS. 4A-5C show the operation of guiding the thin sheet 3 to the transfer position in a stepwise manner. As shown in FIG. 4A, in this process cartridge 17, when the thin sheet 3 is first transported, the front end of the sheet 3 is guided toward the downstream along the first guide face 71A of the first guide member 71 to reach the first leading end 74 from the first base end 73 of the first guide face 71A, and then guided to be in contact with the upstream side of the transfer position in the photosensitive drum 27.

Figure 4B:
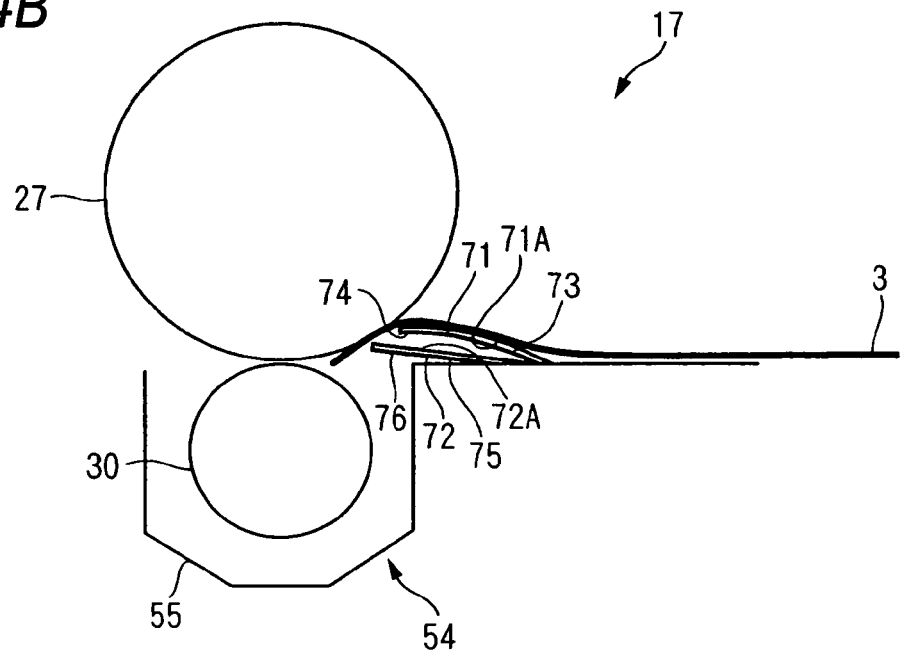

However, the thin sheet 3 is weak, so that the first leading end 74 of the first guide member 71 is not significantly bent even when the front end of the thin sheet 3 is in contact with the photosensitive drum 27 as shown in FIG. 4B, and is guided to the transfer position as it is while the sheet 3 is closely adhered to the photosensitive drum 27.

The thin sheet 3 is then closely adhered to the photosensitive drum 27 in the upstream side of the transfer position from the front end to be guided up to the transfer position near the rear end while being in closely adhered to the photosensitive drum 27 as shown in FIG. 5A.

Accordingly, a gap between the thin sheet 3 and the photosensitive drum 27 is formed in the upstream side of the transfer position, so that the discharge therebetween may be suppressed from occurring. As a result, a discharge shape like a spot of penetrating the sheet 3 called penetration may be prevented from occurring on the thin sheet 3.

In addition, while the thin sheet 3 is guided by the first guide member 71 from its front end to the rear end, a bottom surface of the sheet 3 may slide on the second guide face 72A of the second guide member 72 to be guided to the transfer position, or may be guided to the transfer position without sliding on the second guide face 72A of the second guide member 72.

The second leading end 76 of the second guide face 72A is disposed in the downstream than the projecting plane of the direction where the sheet 3 guided by the first guide face 71A presses the first guide member 71. Accordingly, when the rear end of the thin sheet 3 passes the first leading end 74 of the first guide face 71A, the rear end of the thin sheet 3: falls downward from the first leading end 74 of the first guide face 71A, and is elastically received by the second leading end 76 of the second guide face 72A to be guided to the transfer position as shown in FIGS. 5*b* and 5*c*. Accordingly, the rear end of the thin sheet 3 may be suppressed from fluctuating, and the transfer detect may be prevented from occurring on the rear end.

Description of an Operation Guiding a Thick Sheet to a Transfer Position

Figure 6A:
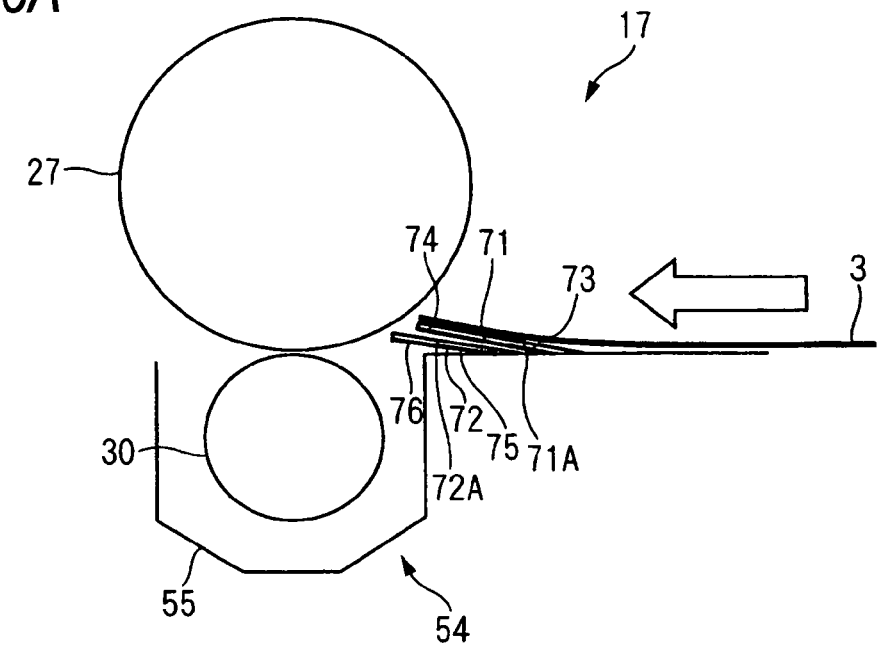

FIGS. 6A-7B show the operation of guiding the thick sheet 3 to the transfer position in a stepwise manner. As shown in FIG. 6A, in this process cartridge 17, when the thick sheet 3 is first transported, the front end of the sheet 3 is guided toward the downstream along the first guide face 71A of the first guide member 71 to reach the first leading end 74 from the first base end 73 of the first guide face 71A, and then guided to be in contact with the upstream side of the transfer position in the photosensitive drum 27.

Figure 6B:
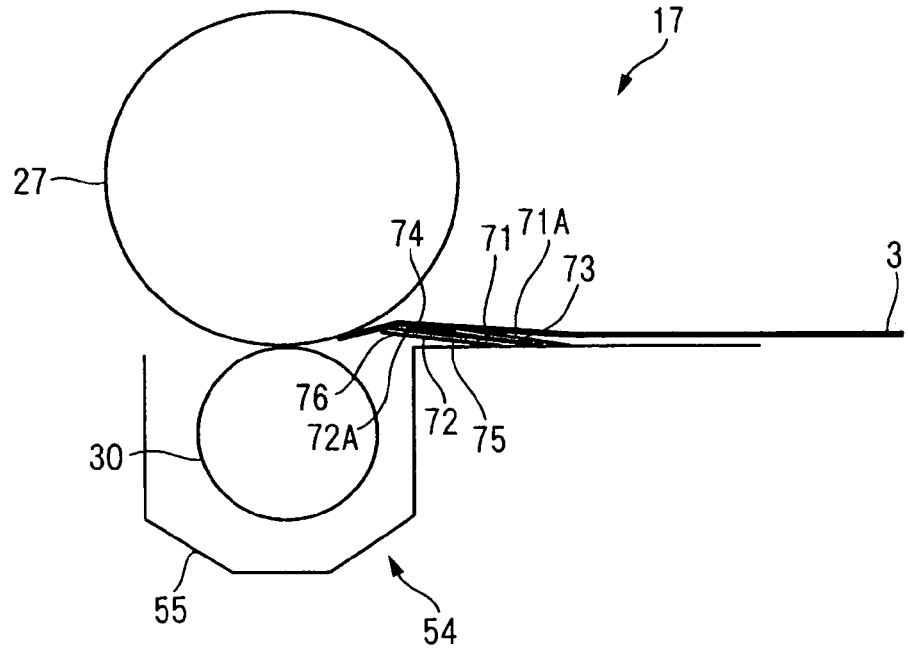

However, the thick sheet 3 is strong, and when the front end of the thick sheet 3 is in contact with the photosensitive drum 27 as shown in FIG. 6B, the second guide member 72 is significantly bent in response to the downward direction resulted from the contact with the front end of the sheet 3, and the thick sheet 3 is guided to the transfer position by the first guide member 71 and the second guide member 72 while the first guide member 71 and the second guide member 72 are in contact with or closer to each other.

As shown in FIG. 2, the plane 78 connecting the second leading end 76 to the second base end 75 of the second guide member 72 and the plane 77 connecting the first leading end 74 to the first base end 73 of the first guide member 71 cross each other in the upstream side of the first base end 73, so that the sheet 3 is in contact with the second guide face 72A at a small angle when the sheet 3 is guided to the second guide face 72A from the first guide face 71A as compared to the case that the second guide member 72 is in parallel with the first guide member 71. Accordingly, the resistant force of the second guide face 72A against the sheet 3 is reduced, so that the sheet 3 may strongly press the second plane 72A to make the second guide face 72A significantly bent in a direction corresponding to the direction where the thick sheet 3 is directed.

Figure 7A:
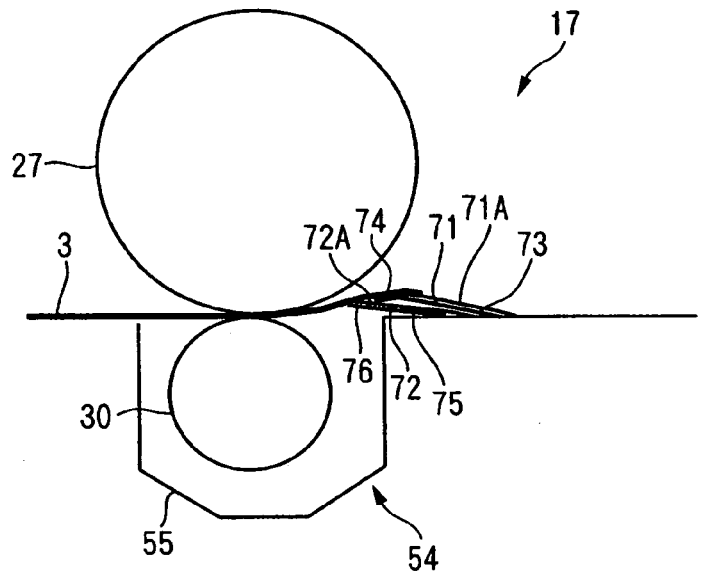

Accordingly, as shown in FIG. 7A, the thick sheet 3 is relatively and exactly guided to the transfer position, so that the transfer detect may be prevented from occurring due to the bending of the thick sheet 3. In addition, the friction when the sheet 3 is in contact with the second guide face 72A may be reduced, so that the vibration may be prevented from occurring on the sheet 3 due to the friction between the second guide face 72A and the sheet 3, thereby preventing the transfer defect from occurring due to the vibration.

In addition, the thick sheet 3 is not apt to have the discharge even when a gap between the sheet and the photosensitive drum 27 is present as compared to the thin sheet 3, so that a discharge shape due to the discharge it does not easily occur even when the thick sheet 3 is relatively and exactly guided to the transfer position.

Figure 7B:
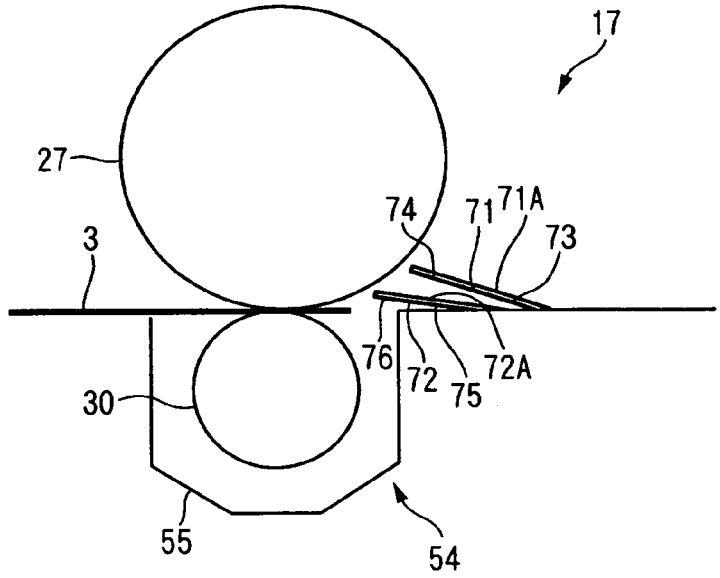

The thick sheet 3 is then guided near the rear end as shown in FIG. 7A, and is continuously received to the second leading end 76 of the second guide face 72A from the first leading end 74 of the first guide face 71A because the first guide member 71 is significantly bent to be in contact with or closer to the second guide member 72, so that the thick sheet is guided to the transfer position as shown in FIG. 7B. Accordingly, the fluttering of the rear end of the thick sheet 3 may be prevented from occurring, thereby preventing the transfer defect in the rear end.

As such, a simplified structure of the process cartridge 17 using the first guide member 71 and the second guide member 72 formed of a flexible film may prevent the transfer defect from occurring in any of the thin and thick sheets 3. And the image is formed on the sheet by the laser printer 1 including the process cartridge 17, so that the safe image formation may be accomplished.

In this case, at least one of the first guide member 71 and the second guide member 72 may be formed of a flexible member other than the film member such as a sponge.

The geometric moment of inertia $I_1$ of the first guide member 71 is set to be greater than the geometric moment of inertia $I_2$ of the second guide member 72, so that the first guide member 71 is stronger than the second guide member 72. Accordingly, in a case of guiding a thin sheet 3, the front end of the thin sheet 3 may be guided closer to the photosensitive drum 27 as much as possible by the first stronger guide member 71. Accordingly, a discharge shape due to the discharge of the thin sheet 3 may be more prevented from occurring.

The second guide member 72 weaker than the first guide member 71, so that the second guide face 72A may apply a relatively weak pressing force to the sheet 3 toward the photosensitive drum 27 to have a relatively small friction between the sheet 3 and the second guide face 72A. Accordingly, the thick sheet 3 is more correctly guided toward the transfer position, so that the transfer defect may be more prevented from occurring due to bending of the thick sheet 3. In addition, the transfer defect may be more prevented from occurring due to the vibration on the sheet 3 resulted from the friction between the sheet 3 and the second guide member 72.

A length from the first leading end 74 to the first base end 73 of the first guide face 71A is longer than a length from the second leading end 76 to the second base end 75 of the second guide face 72A, however, the second guide face 72A is disposed closer to the transfer position than the first guide face 71A, so that the second leading end 76 may be sufficiently disposed closer to the photosensitive drum 27 even when the second guide face is shorter than the first guide face 71A. Accordingly, the sheet 3 may be smoothly guided to the transfer position.

In addition, a product $E_1I_1$ between the geometric moment of inertia $I_1$ and the expanding modulus of elasticity $E_1$ of the first guide member 71 is in a range of $3.49\times10^{-5}\leqq E_1I_1\leqq1.18\times10^{-3}$, and a product $E_2I_2$ between the geometric moment of inertia $I_2$ and the expanding modulus of elasticity $E_2$ of the second guide member 72 is in a range of $3.49\times10^{-5}\leqq E_2I_2\leqq1.18\times10^{-3}$, so that the each of the first guide member 71 and the second guide member 72 may be better bent in response to a thickness of the sheet 3. Accordingly, the sheet 3 may be smoothly guided to the transfer position.

When the contact angle θ1 between the photosensitive drum 27 and the sheet 3 guided by the first guide member 71 is 90°, the front end of the sheet 3 is jammed when the sheet 3 is in contact with the photosensitive drum 27, and when the contact angle θ1 exceeds 90°, the sheet is guided toward the opposite side to the transport location with respect to the contact portion. However, the first guide member 71 is disposed in a location having the contact angle θ1 less than 90° between the photosensitive drum 27 and the sheet 3. Accordingly, when the sheet 3 is in contact with the photosensitive drum 27, the sheet is guided so that the contact angle θ1 between the photosensitive drum 27 and the sheet 3 is less than 90°, so that the sheet 3 may be smooth guided toward the transfer position.

Further, the first guide face 71A and the second guide face 72A are composed of sagged surfaces formed by press working, so that the sheet 3 may be smoothly guided without hanging over the edges 65 of the first guide face 71A and the second guide face 72A.

Figure 8:
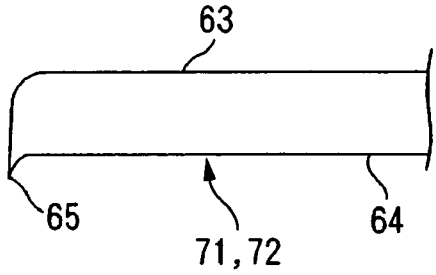
FIG. 8 is a side cross-sectional view illustrating a main part of the front end of the first and second guide members.

That is, when the first guide member 71 and the second guide member 72 are formed by press working, the end 65 of the rear surface 64 at the opposite side to the surface 63 composed of the sagged surface is cut by a shearing force of the cutting blade at the time of press molding to be protruded (i.e., burr) as shown in FIG. 8. And when such rear surface 64 is disposed as the top surface (the first guide face 71A and the second guide face 72A) in contact with the sheet 3, the sheet 3 is stuck in the protruded end 65 (burr) so that the smooth transport may not be accomplished.

However, according to this process cartridge 17, the surface 63 composed of the sagged surface by press working becomes the top surface and the area surface 64 opposite to the surface 63 becomes the bottom surface, and the bottom surface opposes to the top surface of the maintaining unit 57, that is, the rear surface 64 is not in contact with the sheet 3 as described above, so that the sheet 3 may be smoothly guided without hanging over the edge 65 of the rear surface 64.

In addition, the transfer roller 30 is included in the process cartridge 17, so that the first guide member 71 and the second guide member 72 may have the relative location with respect to the transfer position with good accuracy. Accordingly, the transfer defect may be prevented from occurring in any of the thin and thick sheets 3.

The edge of the first leading end 74 of the first guide face 71A is disposed higher than the line L connecting the contact position between the photosensitive drum 27 and the transfer roller 30 to the contact position between two resist rollers 12, so that the sheet 3 may be guided toward the upstream side of the transfer position in the rotation direction of the photosensitive drum 27. Accordingly, the discharge shape due to the discharge of the thin sheet 3 may be surely prevented from occurring.

The first and second guide members 71 and 72 are formed of the insulating material like a resin film, so that the electric conduction through the sheet 3 from the photosensitive drum 27 may be prevented from occurring. Accordingly, the transfer of the toner image may be surely accomplished.

In addition, the first base end 73 of the first guide member 71 and the second base end 75 of the second guide member 72 are fixed to the case 51, so that the photosensitive drum 27, the first and second guide members 71 and 72 may be maintained as one body by the case 51, which thus allows the first and second guide faces 71A and 72A to be surely disposed with respect to the photosensitive drum 27.

As shown in FIG. 3B, when the first guide member 71 and the second guide member 72 are divided in their width directions, the friction resistance at the time of carrying the sheet 3 may be reduced in the first guide member 71 and the second guide member 72, so that the smooth guiding may be accomplished.

Modified Illustrative Aspect

Figure 9:
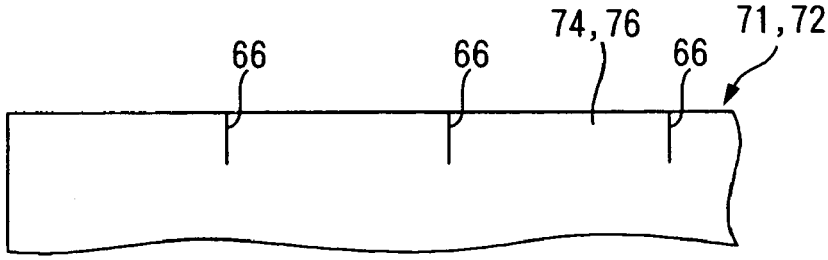
FIG. 9 is a schematic plan view illustrating different structures (i.e. notch shapes) of the first and second guide members.

FIG. 9 is a schematic plan view illustrating another structure of the first guide member 71 and the second guide member 72. A plurality of notches 66 are formed in parallel with each other and spaced apart from each other by the substantially same interval in the width direction orthogonal to the conveying direction of the sheet 3 in the first leading end 74 of the first guide member 71 and the second leading end 76 of the second guide member 72. Each notch 66 extends on its intermediate way toward the first base end 73 or the second base end 75 from the edge of the first leading end 74 or the edge of the second leading end 76 along the conveying direction of the sheet 3 (see FIG. 2).

By forming such notches 66, the first guide member 71 and the second guide member 72 may be mounted on the maintaining unit 57 (see FIG. 2) with good accuracy without having the crease on the first guide member 71 and the second guide member 72.

That is, the first guide member 71 and the second guide member 72 are thin and elongated along their width directions, so that a deviation occurs in locations of the central portions of the width directions of the first guide member 71 and the second guide member 72 when both ends of the width direction of the first guide member 71 and the second guide member 72 are aligned with respect to and mounted (connected) on the maintaining unit 57. In addition, when one ends of the width direction of the first guide member 71 and the second guide member 72 are aligned with respect to the maintaining unit 57 and are mounted toward the other ends of the width direction from the one ends in order, the deviation of the locations of the central portions of the width directions of the first guide member 71 and the second guide member 72 may be avoided, however, the first guide member 71 and the second guide member 72 are apt to have a crease.

According to the first guide member 71 and the second guide member 72 of the present illustrative aspect, a plurality of notches 66 are formed therein, so that the crease, which occurs when the first guide member 71 and the second guide member 72 are mounted on the maintaining unit 57 from their one ends of the width direction in order, may be absorbed by each notch 66. Accordingly, first guide member 71 and the second guide member 72 may be mounted on the maintaining unit 57 with good accuracy without having the crease on the first guide member 71 and the second guide member 72.

In addition, the first leading end 74 of the first guide member 71 and the second leading end 76 of the second guide member 72 are divided into a plurality of parts in their width directions by the notch 66, so that the first guide member 71 and the second guide member 72 may be made to be bent only in a portion in contact with the sheet 3 at the time of continuously carrying the sheet 3 having a narrow width. Accordingly, when the sheet 3 having a narrow width is continuously transported, the entire first and second guide members 71 and 72 may be prevented from bending in response to the bending of the portion in contact with the sheet 3, and reliability about the durability of the first guide member 71 and the second guide member 72 may be enhanced.

In addition, only one notch 66 may be formed in the first leading end 74 of the first guide member 71 or the second leading end of the second guide member 72. In addition, when a plurality of notches 66 are formed, each interval between the notches 66 may not be necessarily substantially the same in the width direction, but may be different. For example, to comply with various sizes of the sheet 3 available in the laser printer 1, the notch 66 may be formed in locations corresponding to both edges of the width direction of the sheet 3 having various sizes to be transported onto the first guide member 71 or the second guide member 72 in the first leading end 74 of the first guide member 71 or the second leading end 76 of the second guide member 72. In this case, the first guide member 71 or the second guide member 72 may be made to be bent only in a portion in contact with the sheet 3 at the time of carrying the sheet 3.

Figure 10:
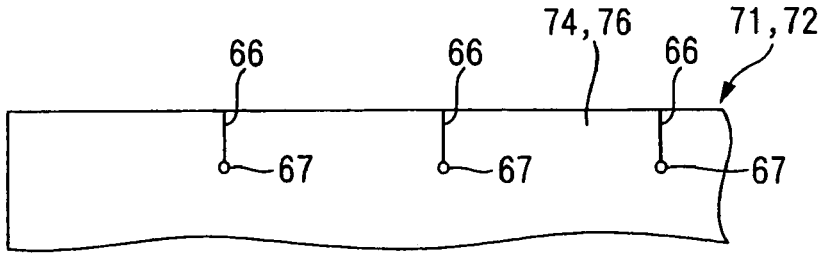
FIG. 10 is a schematic plan view illustrating separation stoppers formed in ends of different structures (i.e. notch shapes) of the first and second guide members.

FIG. 10 is a schematic plan view illustrating another structure of the first guide member 71 and the second guide member 72. Referring to FIG. 10, same reference numerals as those of FIG. 9 are given to the parts corresponding to the parts shown in FIG. 9, and the detailed description thereof will be skipped below.

A separation stopper 67 is formed at an end of the first base end 73 or the second base end 75 of each notch 66 in the first guide member 71 and the second guide member 72 shown in FIG. 10. The separation stopper 67 is formed as a substantially circular hole when seen its plan view at the end of each notch 66, and penetrates from the top surfaces of the first guide member 71 and the second guide member 72 in contact with the sheet 3 to the bottom surface of the opposite side along the conveying direction of the sheet 3.

Accordingly, first guide member 71 and the second guide member 72 may be prevented from being separated from the end of each notch 66.

FIGS. 11A-11D are schematic plan views illustrating another structure of the first guide member 71 and the second guide member 72. A plurality of slits 68 are disposed in parallel with each other by a substantially same interval in the width direction orthogonal to the conveying direction of the sheet in the first leading end 74 and the second leading end 76 of the first guide member 71 and the second guide member 72 shown in FIGS. 11*a* to 11*d*, respectively. Each slit 68 extends on its intermediate way toward the first base end 73 or the second base end 75 from the edge of the first leading end 74 or the edge of the second leading end 76 along the conveying direction of the sheet 3 (see FIG. 2).

By forming the plurality of slits 68, as the is the same case as the notch 66, the first guide member 71 and the second guide member 72 may be mounted on the maintaining unit 57 with good accuracy without having the crease on the first guide member 71 and the second guide member 72. In addition, when the sheet 3 having a narrow width is continuously transported, the entire first and second guide members 71 and 72 may be prevented from bending in response to the bending of the portion in contact with the sheet 3, and reliability about the durability of the first guide member 71 and the second guide member 72 may be enhanced.

Figure 11A:
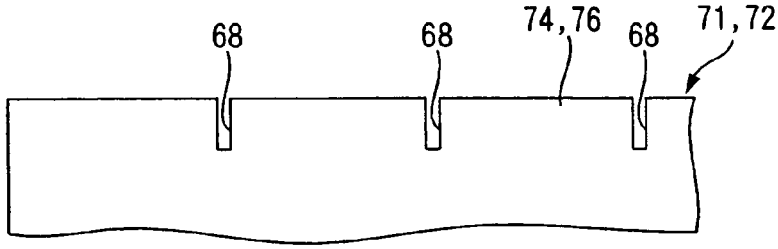
Figure 11B:
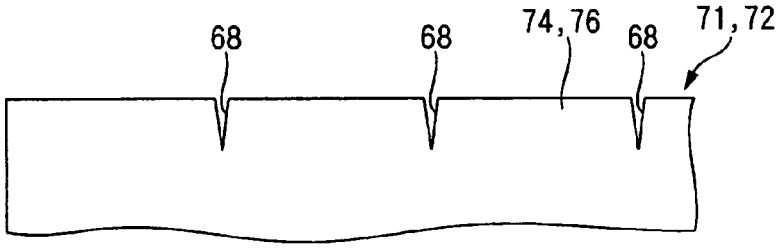
Figure 11C:
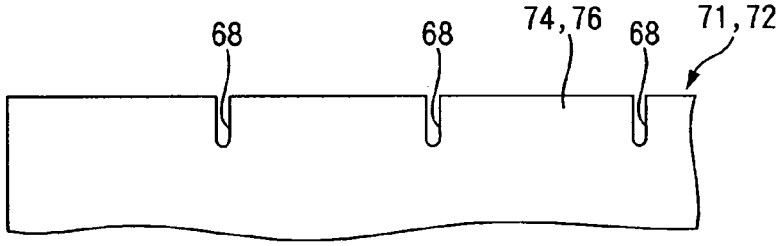

Further, the slit 68, unlike the notch 66, has a width in a direction orthogonal to the conveying direction of the sheet 3, so that the portion between the first and second guide members 71 and 72 with the slit 68 interposed therebetween may be more prevented from overlapping each other when the first and second guide members 71 and 72 are mounted on the maintaining unit 57. In addition, each slit 68 may be substantially rectangular when seen its plan view as shown in FIG. 11A, may be substantially V-shaped when seen its plan view as shown in FIG. 11B, and may be substantially U-shaped when seen its plan view as shown in FIG. 11C.

When each slit 68 is substantially rectangular or is substantially U-shaped when seen its plan view, the first guide member 71 and the second guide member 82 may be prevented from being separated from the end of the first base end 73 or the second base end 75 of each slit 68 (see FIG. 2).

In addition, when each slit 68 is substantially V-shaped when seen its plan view, a portion between the first and second guide members 71 and 72 with the slit 68 interposed therebetween is far away toward the front end from the rear end, so that the portion between the first and second guide members 71 and 72 with the slit 68 interposed therebetween may be more prevented from overlapping each other when the first and second guide members 71 and 72 are mounted on the maintaining unit 57.

Figure 11D:
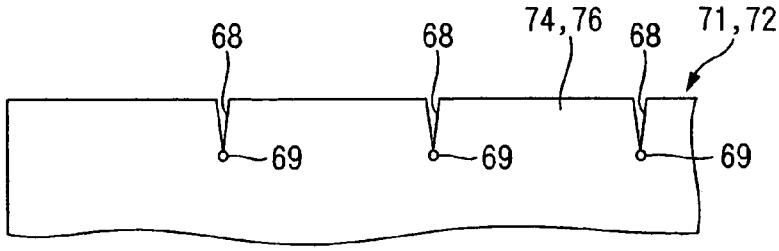

In this case, as shown in FIG. 11D, a separation stopper 69 is preferably formed at an end of the first base end 73 or the second base end 75 of the slit 68. The separation stopper 69 is formed as a substantially circular hole when seen its plan view at the end of each slit 68, and penetrates from the top surface of the first guide member 71 and the second guide member 72 in contact with the sheet 3 to the bottom surface of the opposite side along the conveying direction of the sheet 3. By forming the separation stopper 69, the first guide member 71 and the second guide member 82 may be prevented from being separated at the deepest part of each slit 68.

In addition, slit 68 may be disposed only one in the first leading end 74 of the first guide member 71 or the second leading end 76 of the second guide member 72. In addition, when a plurality of slits 68 are formed, each interval between the slits 68 may not be necessarily substantially the same in the width direction, but may be different. For example, to comply with various sizes of the sheet 3 available in the laser printer 1, the slit 68 may be formed in locations corresponding to both edges of the width direction of the sheet 3 having various sizes to be transported onto the first guide member 71 or the second guide member 72 in the first leading end 74 of the first guide member 71 or the second leading end 76 of the second guide member 72. In this case, the first guide member 71 or the second guide member 71 may be made to be bent only in a portion in contact with the sheet 3 at the time of carrying the sheet 3.

Figure 12:
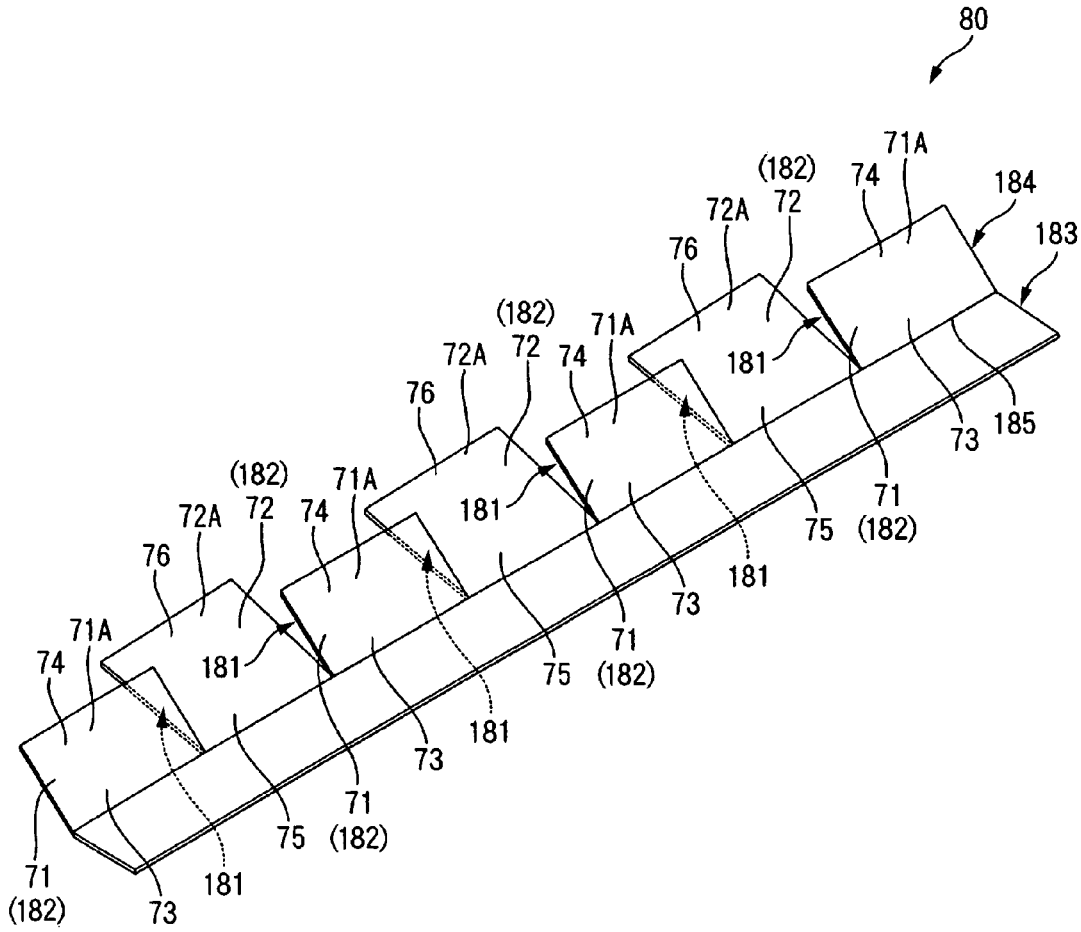
FIG. 12 is a perspective view illustrating different structures of the first and second guide members 71 and 72 (of which the first and second guide members are formed as one plate member)

FIG. 12 is a perspective view illustrating another structure of the first guide member 71 and the second guide member 72.

Referring to FIG. 12, the first guide member 71 and the second guide member 72 are formed of an insulating material having flexibility, for example, a resin like polyethylene-terephthalate, and are composed of substantially one rectangular plate member 80 formed of a film member formed by press working.

A longitudinal direction of the plate member 80 is directed toward the width direction, and a bottom surface of the based end 183 as the rear end of the shorter side direction is fixed along the rear end of the maintaining unit 57 shown in FIG. 2. The leading end 184 as the front end of the shorter side direction of the plate member 80 is disposed closer to the photosensitive drum in the upstream side of the transfer position.

A plurality of notches 181, which extend on an intermediate way toward the base end 183 along the shorter side direction of the plate member 80 from the edge of the leading end 184, are formed along the width direction, so that a plurality of leading end pieces 182 are formed along the width direction.

The plurality of leading end pieces 182 alternately have different lengths from each other along the width direction. In this case, the length is from the rear end to the front end of the leading end piece. And the leading end piece 182, which has the shorter length from the front end (first leading end 74) to the rear end (first base end 73), constitutes the first guide member 71, and the leading end piece 182, which has the longer length from the front end (second leading end 76) to the rear end (second base end 75), constitutes the second guide member 72. A top surface of the first guide member 71 constitutes the first guide face 71A, and a top surface of the second-guide member 72 constitutes the second guide face 72A. Accordingly, only one plate member 80 may be used to simply form the first guide member 71 and the second guide member 72.

The first guide member 71 and the second guide member 72 are bent with different angles from each other on the basis of the edge of the rear end of the notch 81 as a center in the direction (upward) opposite to the direction where the sheet 3 presses the first guide member 71 and the second guide member 72. An inclined angle of the first guide member 71 with respect to the direction where the base end 183 of the plate member 80 extends in its shorter direction, that is, the inclined angle θ3 of the first guide member 71 with respect to the maintaining unit 57 is 30°to 45°, and preferably about 30°. An inclined angle of the second guide member 72 with respect to the direction where the base end 183 of the plate member 80 extends in its shorter direction, that is, the inclined angle θ4 of the second guide member 72 with respect to the maintaining unit 57 is 10° to 40°, preferably about 20°, and is smaller than the inclined angle θ3 of the first guide member 71 with respect to the maintaining unit 57.

As such, the inclined angle θ4 of the second guide member 72 with respect to the maintaining unit 57 is set to be smaller than the inclined angle θ3 of the first guide member 71 with respect to the maintaining unit 57, so that the plane connecting the first leading end 74 to the first base end 73 of the first guide member 71 and the plane connecting the second leading end 76 to the second base end 75 of the second guide member 72 cross each other on a straight line 85 connected to the first based end 73, that is, the edge of the rear end of the notch 81. Accordingly, the transfer defect may be prevented from occurring in any of the thin and thick sheets 3 by the same operation as the first guide member 71 and the second guide member 72 of the above-described illustrative aspects.

Figure 13:
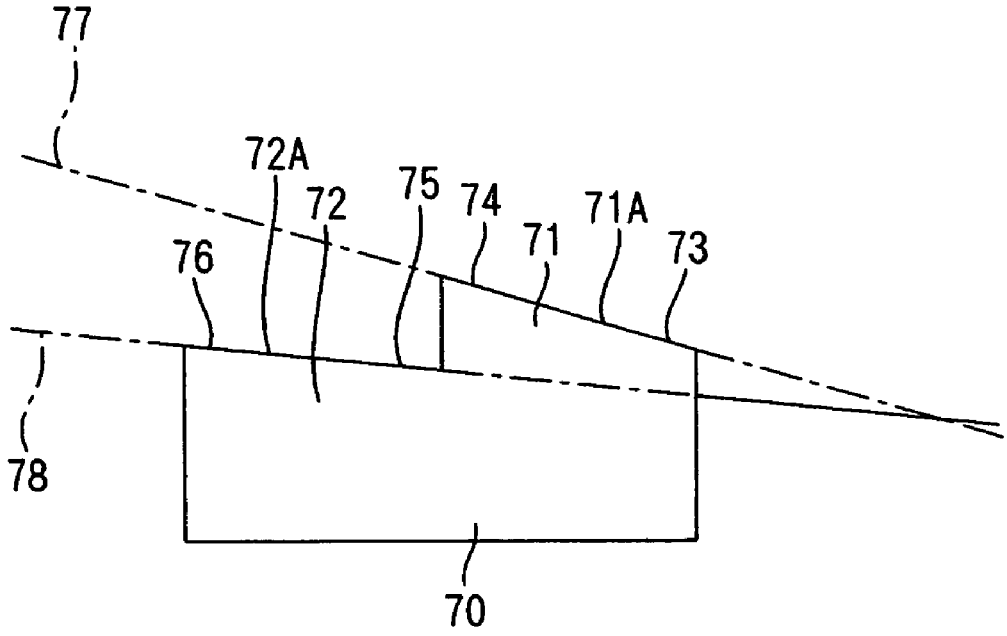
FIG. 13 is a side view illustrating different structures of the first and second guide members 71 and 72 (of which the first and second guide members are formed as single sponge member)

FIG. 13 is a side view illustrating another structure of the first guide member 71 and the second guide member 72. Referring to FIG. 13, the first guide member 71 and the second guide member 72 are formed as one body by a flexible member 70 like a sponge. That is, a bottom surface of the flexible member 70 is disposed to oppose to the top surface of the maintaining unit 57, and the first guide face 71A and the second guide face 72A are formed with different inclined angles from each other on its top surface. A portion forming the first guide face 71A of the flexible member 70 constitutes the first guide face 71, and a portion forming the second guide face 72A of the flexible member 70 constitutes the second guide face 72.

The plane 77 connecting the first leading end 74 to the first base end 73 of the first guide face 71A and the plane 78 connecting the second leading end 76 to the second base end 75 of the second guide face 72A cross each other in the upstream side of the first base end 73. Accordingly, the transfer defect may be prevented from occurring in any of the thin and thick sheets 3 by the same operation as the first guide member 71 and the second guide member 72 of the above-described illustrative aspects.

In addition, the transfer roller 30, the first guide member 71 and the second guide member 72 are disposed in the process cartridge 17 in the illustrative aspects and the modified illustrative aspects, however, they may be disposed at the main body case 2.

In addition, a combination of the same property of material as the illustrative aspects (the geometric moment of inertia, length, product between the expanding modulus of elasticity and the geometric moment of inertia, material, and so forth), and the arrangements (contact angle between the sheet and the photosensitive drum, direction of the sagged surface by press working, and so forth) may be implemented in the modified illustrative aspect.

Second Illustrative Aspect

Hereinafter, a laser printer 1 according to a second illustrative aspect will be described with reference to the drawings.

In the following description and drawings for the second illustrative aspect, parts the same as those in the first illustrative aspect are denoted by the same reference numerals as those in the first illustrative aspect, and detailed description of the parts and configurations the same as those in the first illustrative aspect will be omitted.

Figure 14:
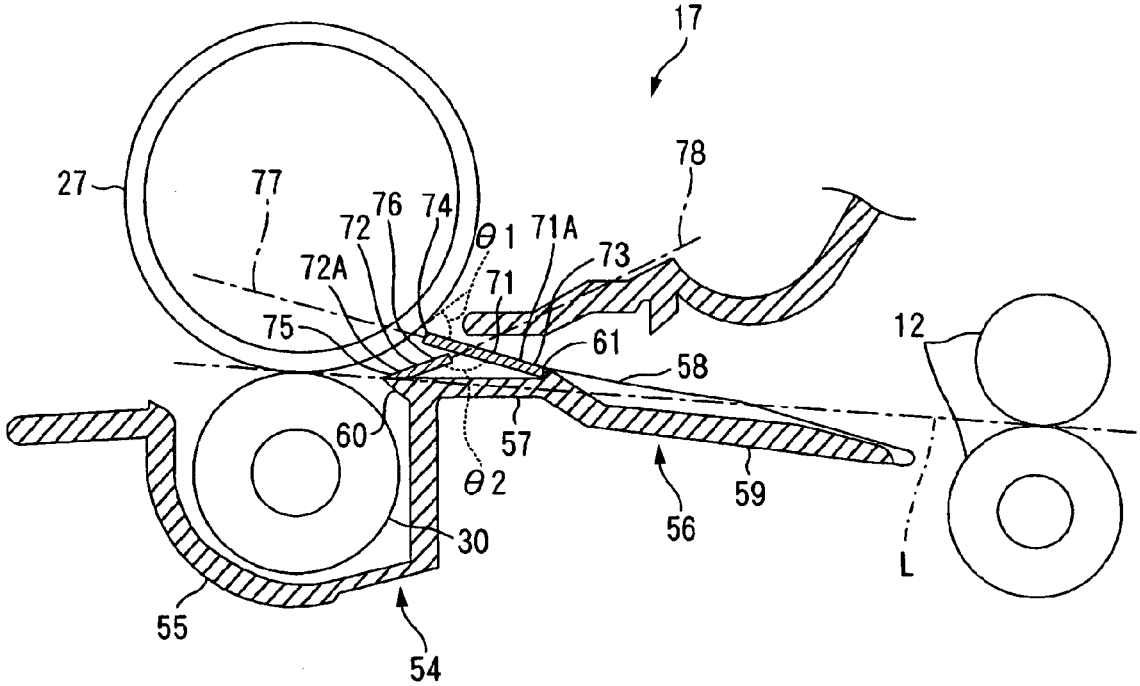
FIG. 14 is a side sectional view of a main part of a process cartridge of a laser printer as an image forming apparatus according to a second illustrative aspect.

As shown in FIG. 14, the second guide member 72 of the laser printer according to the second illustrative aspect is configured to be upwardly inclined from downstream to upstream and fixed on an upper surface of a front end part of a supporting part 57. A second base end 75, which is a front end part of the second guide member 72, is provided at a downstream side of a first base end 73 of the first guide member 71. An extended part 60, which has a triangular shape in section, is provided to protrude on an upside of a transfer roller prop 55 on the front end part of the supporting part 57. The first base end 73 of the first guide member 71 is fixed on an upper surface of the extended part 60. The second guide member 72 is extended to an upstream side from the second base end 75. An upper surface of the second guide member 72 forms a second guide face 72A for guiding a sheet 3 toward the photosensitive drum 27. That is, the second guide face 72A extends to a direction opposite to an extending direction of the first guide face 71A. The second guide member 72 has a thickness of about 0.075 to 0.125 mm and, more preferably, of 0.100 mm.

A second leading end 76, which is a rear end part of the second guide member 72, is provided at a lower side of a first leading end 74 of the first guide member 71 and is separated from the first leading end 74. That is, the second leading end 76 of the second guide face 72A is provided in a projected plane of the first guide face 71A, which is located to a direction (downward direction) in which the sheet 3 guided to the first guide face 71A pressurizes the first guide face 71A.

The second leading end 76 of the second guide member 72 may be provided to contact the first leading end 74 of the first guide member 71. The second leading end 76 of the second guide member 72 may be provided to be separated from or contact the first leading end 74 on the downstream side (on the photosensitive drum 27 side) of the first leading end 74 of the first guide member 71.

When the surface at the side in contact with the cutting blade at the time of press working is a surface and a surface opposite to the surface is a rear surface in each of the first guide member 71 and the second guide member 72, the surface, that is, the sagged surface of the press working is disposed to the top surface (the first guide face 71A and the second guide face 72A) in contact with the sheet 3, and the rear surface is disposed to be the bottom surface opposing to the top surface of the maintaining unit 57.

The edge of the first leading end 74 of the first guide face 71A and the edge of the second leading end 76 of the second guide face 72A are disposed above the line L connecting contact position (transfer position) between the photosensitive drum 27 and the transfer roller 30 to the contact position between the two resist rollers 12 opposite to each other.

Figure 15A:
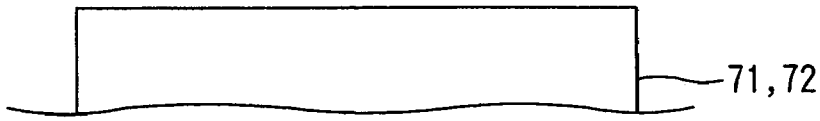

The first guide member 71 and the second guide member 72 may be disposed in the width direction orthogonal to the conveying direction of the sheet 3, that is, the direction in parallel with the axis direction of the photosensitive drum 27 as shown in FIG. 15A.

Figure 15B:
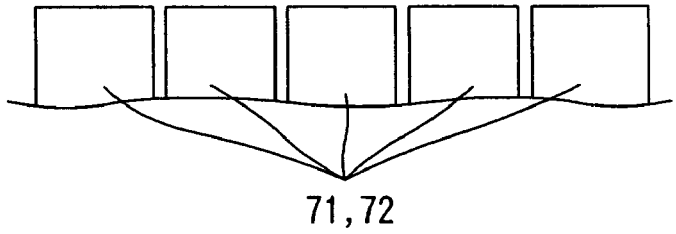

In addition, the first guide member 71 and the second guide member 72 may be divided to be disposed in parallel with each other by a predetermined interval in the direction orthogonal to the conveying direction of the sheet 3 as shown in FIG. 15B.

The first guide member 71 may use the bending of the first leading end 74 to set the contact position between the sheet 3 and the photosensitive drum 27, and is disposed in a location capable of guiding the sheet at the contact angle θ1 between the sheet 3 and the photosensitive drum 27 less than 90°. In addition, the second guide member 72 may use the bending of the second leading end 76 to set the contact position between the sheet 3 and the photosensitive drum 27, and is disposed in a location capable of guiding the sheet at the contact angle θ2 between the sheet 3 and the photosensitive drum 27 less than 90°. The inclined angles of the first guide member 71 and the second guide member 72 with respect to the maintaining unit 57 are set such that θ1 is larger than θ2.

The first guide member 71 is formed to have a product $E_1I_1$ between an expanding modulus of elasticity $E_1$ in a direction in parallel with the conveying direction of the sheet 3 and geometric moment of inertia $I_1$ in a direction in parallel with the longitudinal direction of the photosensitive drum 27 and vertical to the largest plane (top surface of bottom surface) of the first guide member 71 in a range of $3.49\times10^{-5}\leqq E_1I_1\leqq1.18\times10^{-3}$. And the second guide member 72 is formed to have a product $E_2I_2$ between an expanding modulus of elasticity $E_2$ in a direction in parallel with the conveying direction of the sheet 3 and geometric moment of inertia $I_2$ in a direction in parallel with the axis direction of the photosensitive drum 27 and vertical to the largest plane (top surface of bottom surface) of the second guide member 72 in a range of $3.49\times10^{-5}\leqq E_2I_2\leqq1.18\times10^{-3}$.

A length between the first leading end 74 and the first base end 73 is formed to be longer than a length between the second leading end 76 and the second base end 75 of the second guide face 72A. As described above, since the first guide member 71 is provided to be thicker than the second guide member 72, the geometric moment of inertia $I_1$ of the first guide member 71 is set to be larger than the geometric moment of inertia $I_2$ of the second guide member 72.

In this case, the method of setting the geometric moment of inertia $I_1$ of the first guide member 71 greater than the geometric moment of inertia $I_2$ of the second guide member 72, is not limited to the method of forming the first guide member 71 thicker than the second guide member 72 as described above, but may employ a method of forming a length of the width direction of the first guide member 71 longer than a length of the width direction of the second guide member 72.

A tilt angle θ3 (see FIG. 17C) of the first guide member 71 to the supporting part 57 and a tile angle θ4 (see FIG. 17C) of the second guide member 72 to the supporting part 57 are preferably about 30 to 45° and 30°, respectively. Since both the tilt angle θ3 of the first guide member 71 to the supporting part 57 and the tile angle θ4 of the second guide member 72 to the supporting part 57 are set to be smaller than 45°, a plane 77, which is formed by connecting the first leading end 74 and the first base end 73 of the first guide member 71, and a plane 78, which is formed by connecting the second leading end 76 and the second base end 75 of the second guide member 72, cross each other to form an obtuse angle θ2 therebetween (see FIG. 14).

Figure 17A:
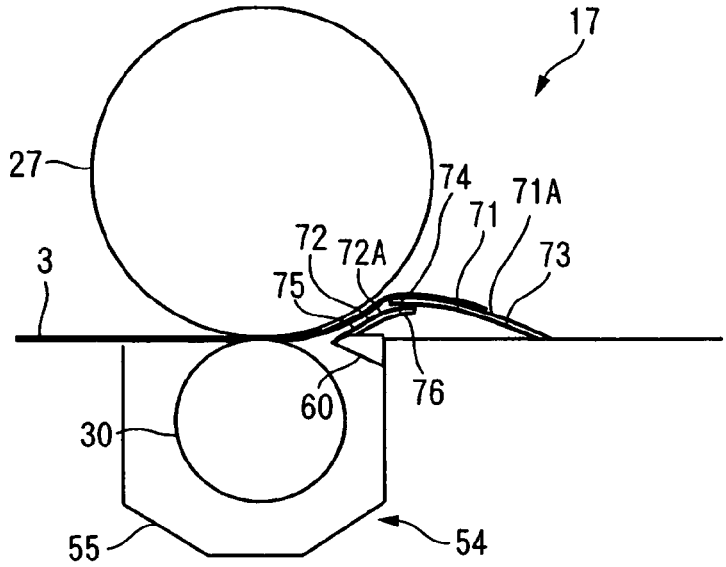
Figure 17B:
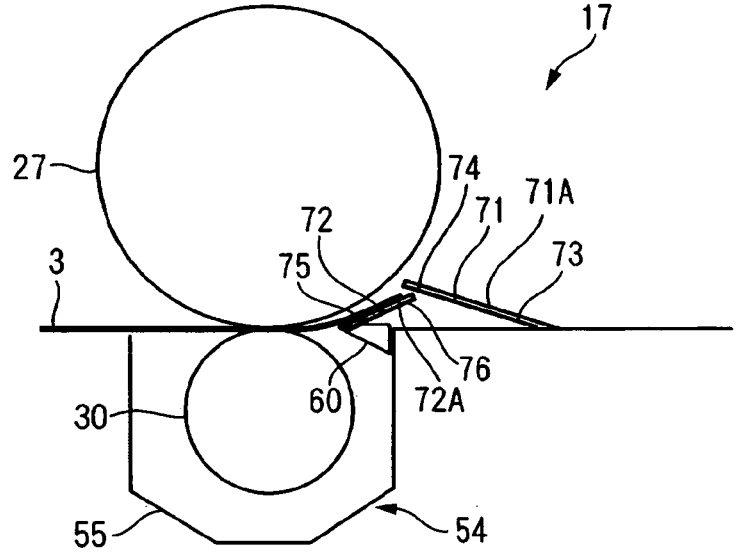
Figure 17C:
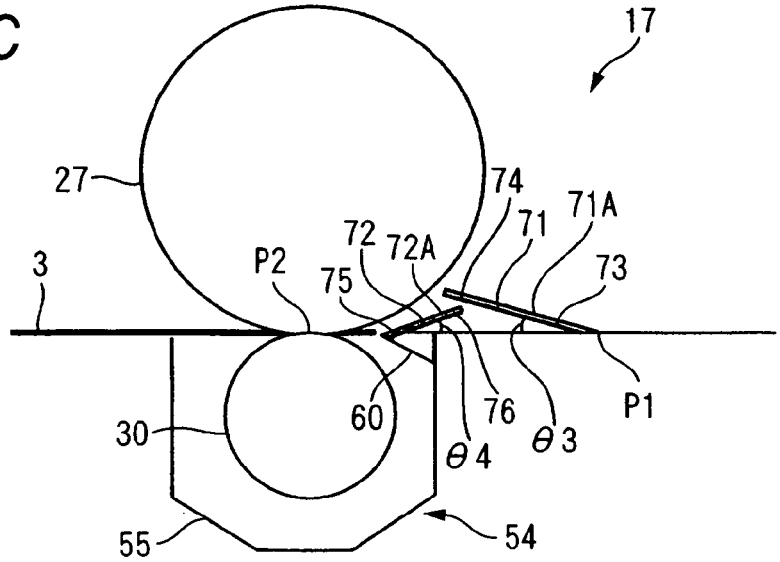

In addition, the tilt angles θ3 and 04 may be an angle about a line formed by connecting a direct upstream side P1 of the first guide member 71 and a transfer position P2 with each other on a sheet conveying path (see FIG. 17C). The tilt angles θ3 and θ4 may be angles about a line formed by connecting an edge of the first base end 73 of the first guide member 71 and an edge of the second base end 75 of the second guide member 72 with each other.

In the process cartridge 17 configured in such a manner, a detailed description of a process for guiding the thin sheet 3 and the thick sheet $^3$ to a transfer position by means of the first and second guide members 71 and 72 will be given. In the present illustrative aspect, when it is assumed that the sheet 3 having an ordinary thickness (ordinary sheet) weighs 75 to 105 g/m$^2$, the ordinary sheet or a sheet (for example, a tracing sheet) that weighs 56 to 75 g/m$^2$ is hereinafter referred to as a thin sheet, and a sheet (for example, a postcard) that weighs 105 to 200 g/m$^2$ is hereinafter referred to as a thick sheet.

Figure 16A:
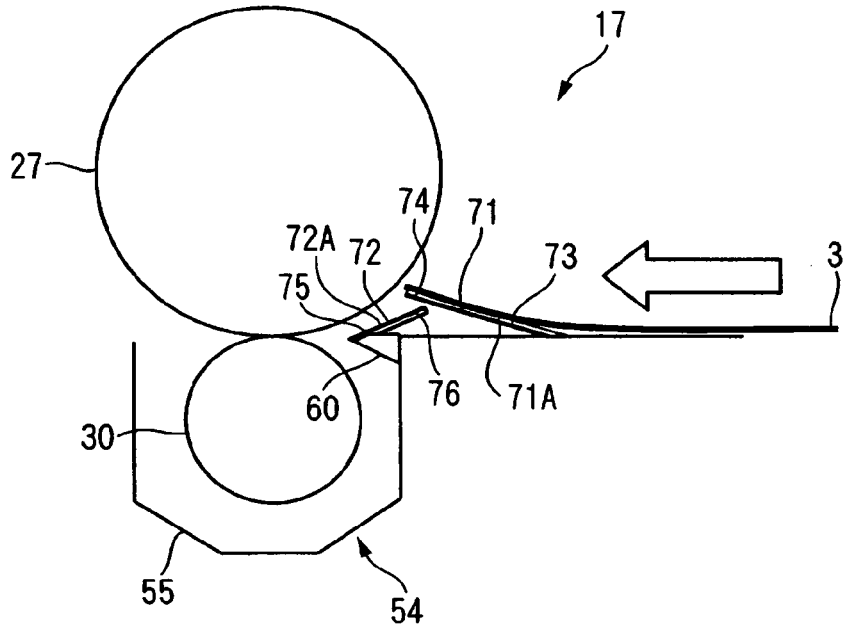

Operation of Guiding a Thin Sheet to a Transfer Position by Means of the First and Second Guide Members FIGS. 4 and 5 show operation of guiding a thin sheet 3 to a transfer position step by step by means of the first and second guide members 71 and 72. As shown in FIG. 16A, in the process cartridge 17, when the thin sheet 3 is carried in, the front end part of the sheet 3 is guided to a downstream side along the first guide face 71A of the first guide member 71, is carried from the first base end 73 to the first leading end 74 of the first guide face 71A, and is guided to contact an upstream side of the transfer position on the photosensitive drum 27.

Figure 16B:
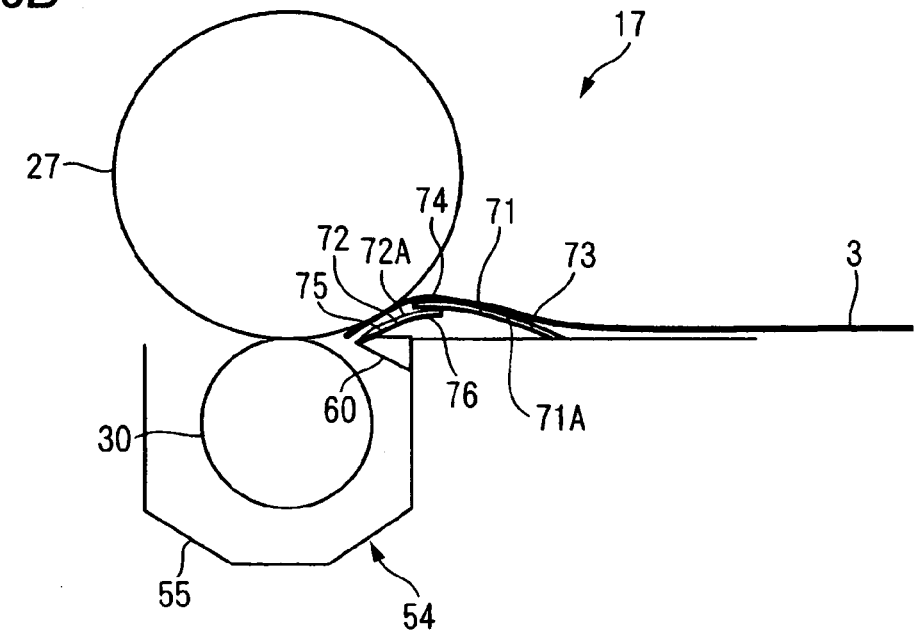

However, the thin sheet 3 is weak, so that the first leading end 74 of the first guide member 71 is not significantly bent even when the front end of the thin sheet 3 is in contact with the photosensitive drum 27 as shown in FIG. 16B, and is guided to the transfer position as it is while the sheet 3 is closely adhered to the photosensitive d rum 27.

The thin sheet 3 is then closely adhered to the photosensitive drum 27 in the upstream side of the transfer position from the front end to be guided up to the transfer position near the rear end while being in closely adhered to the photosensitive drum 27 as shown in FIG. 17A.

Accordingly, a gap between the thin sheet 3 and the photosensitive drum 27 is formed in the upstream side of the transfer position, so that the discharge therebetween may be suppressed from occurring. As a result, a discharge shape like a spot of penetrating the sheet 3 called penetration may be prevented from occurring on the thin sheet 3.

In addition, while the thin sheet 3 is guided by the first guide member 71 from its front end to the rear end, a bottom surface of the sheet 3 may slide on the second guide face 72A of the second guide member 72 to be guided to the transfer position, or may be guided to the transfer position without sliding on the second guide face 72A of the second guide member 72.

The second leading end 76 of the second guide face 72A is disposed in the downstream than the projecting plane of the direction where the sheet 3 guided by the first guide face 71A presses the first guide member 71. Accordingly, when the rear end of the thin sheet 3 passes the first leading end 74 of the first guide face 71A, the rear end of the thin sheet 3 falls downward from the first leading end 74 of the first guide face 71A, and is elastically received by the second leading end 76 of the second guide face 72A to be guided to the transfer position as shown in FIGS. 17B and 17C. Accordingly, the rear end of the thin sheet 3 may be suppressed from fluctuating, and the transfer detect may be prevented from occurring on the rear end.

Description of an Operation Guiding a Thick Sheet to a Transfer Position

Figure 18A:
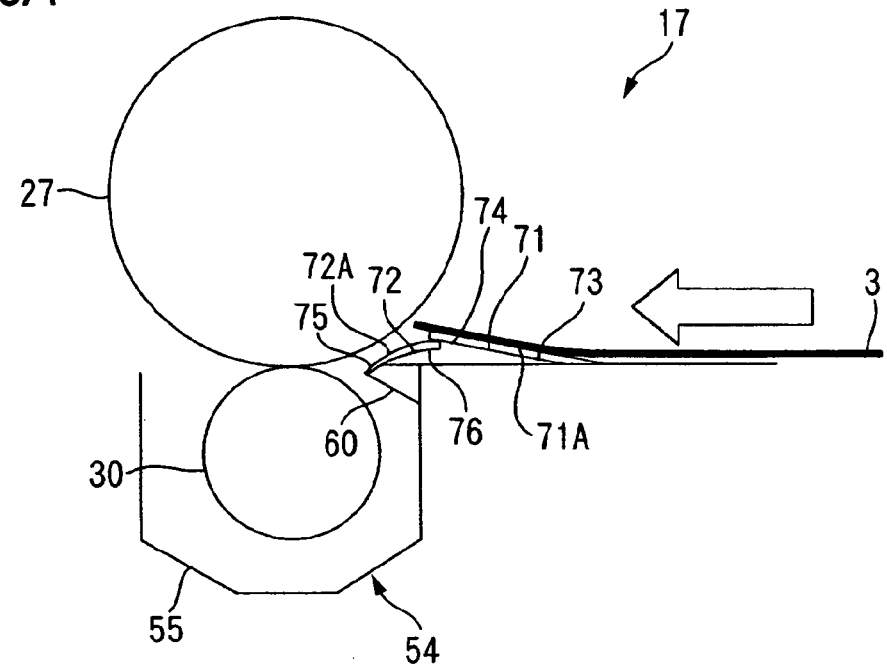

FIGS. 18A-19B show the operation of guiding the thick sheet 3 to the transfer position in a stepwise manner. As shown in FIG. 18A, in this process cartridge 17, when the thick sheet 3 is first transported, the front end of the sheet 3 is guided toward the downstream along the first guide face 71A of the first guide member 71 to reach the first leading end 74 from the first base end 73 of the first guide face 71A, and then guided to be in contact with the upstream side of the transfer position in the photosensitive drum 27.

Figure 18B:
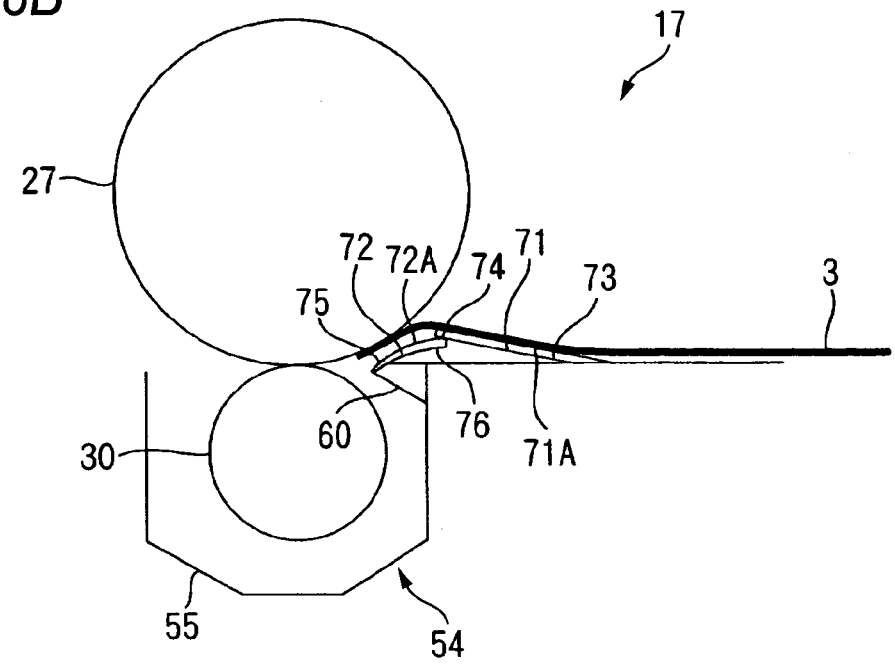

However, as shown in FIG. 18B, the thick sheet 3 is hard. Thus, when the front end part of the thick sheet 3 contacts the photosensitive drum 27, the first leading end 74 is greatly bent with respect to the first base end 73, such that the second guide member 72 guides the thick sheet 3 in a close contact with the photosensitive drum 27.

The second guide face 72A extends to a direction opposite to an extending direction of the first guide face 71A, and the second front tip part 76 is provided at a lower side of the first leading end 74 of the first guide face 71A. Thus, as shown in FIG. 18B, when the thick sheet 3 is guided from the first guide face 71A to the second guide face 72A, it contacts the second guide face 72A from the second leading end 76 to the second base end 75. The thick sheet 3 is pressurized by the second guide face 72A from a direction approaching the photosensitive drum 27 toward a downstream side. Thus, as the sheet 3 is carried to the transfer position, it is possible to greatly bend the second leading end 76 with respect to the second base end 75 on the second guide face 72A.

Figure 19A:
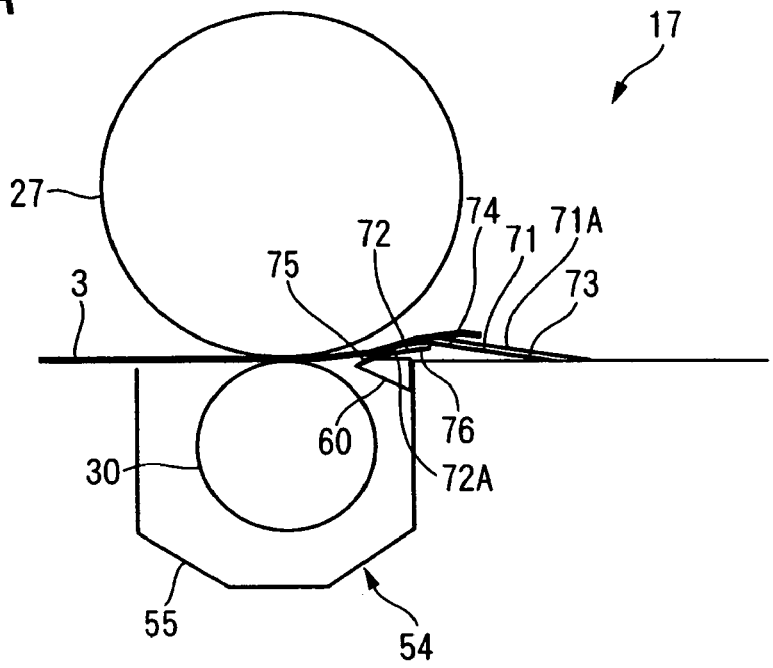

Accordingly, as shown in FIG. 19A, the thick sheet 3 is relatively and exactly guided to the transfer position, so that the transfer detect may be prevented from occurring due to the bending of the thick sheet 3. In addition, the friction when the sheet 3 is in contact with the second guide face 72A may be reduced, so that the vibration may be prevented from occurring on the sheet 3 due to the friction between the second guide face 72A and the sheet 3, thereby preventing the transfer defect from occurring due to the vibration.

In addition, the thick sheet 3 is not apt to have the discharge even when a gap between the sheet and the photosensitive drum 27 is present as compared to the thin sheet 3, so that a discharge shape due to the discharge it does not easily occur even when the thick sheet 3 is relatively and exactly guided to the transfer position.

Figure 19B:
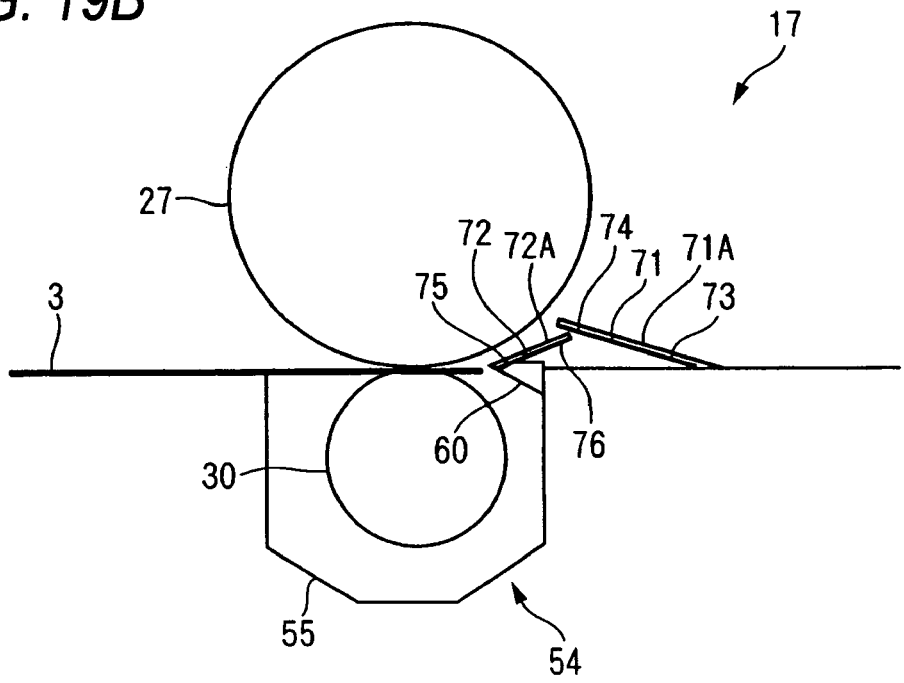

As shown in FIG. 19A, the first guide member 71 is greatly bent and contacts or approaches the second guide member 72. Thus, after the rear end of the thick sheet 3 is guided to the transfer position, the sheet 3 is continuously carried from the first leading end 74 of the first guide face 71A to the second guide face 72A and is guided to the transfer position as shown in FIG. 19B. Accordingly, it is possible to prevent fluttering of the rear end of the thick sheet 3 and to smoothly guide the thick sheet 3 to the transfer position, thereby preventing a transfer failure.

That is, since the process cartridge 17 uses the first and second guide members 71 and 72 formed of a flexible film member, it can smoothly guide the thin or thick sheet 3 to the transfer position. Therefore, it is possible to prevent a transfer failure. In addition, since an image is formed on a sheet by the use of the laser printer 1 equipped with the process cartridge 17, it is possible to form a stable image.

However, at least one of the first and second guide members 71 and 72 may be formed of a flexible member, such as a sponge, other than a film.

Since the second front tip part 76 of the second guide member 72 is separated from the first guide member 71 in the process cartridge 17, it is possible to provide each of the first and second guide members 71 and 72 in a predetermined tilt angle. Thus, it is possible to securely guide the sheet 3 to the transfer position without a transfer failure.

In addition, since the first base end 73 of the first guide member 71 and the second base end 75 of the second guide member 72 are provided with a gap therebetween, the first and second guide members 71 and 72 are independently formed. Accordingly, it is possible to securely provide the first and second guide faces 71A and 72A.

In addition, since the second leading end 76 of the second guide member 72 is provided at a lower side of the first guide member 71, it is possible to smoothly guide the front end of the sheet 3 without contacting the second leading end 76 of the second guide member 72.

In addition, since a plane 77, which is formed by connecting the first leading end 74 and the first base end 73 the first guide member 71 to each other, and a plane 78, which is formed by connecting the second leading end 76 and the second base end 75 of the second guide member 72 to each other, cross each other to form an obtuse angle θ2 therebetween, the sheet 3 may be bent less compared with a case where they cross each other to form an acute angle or a right angle. Accordingly, it is possible to guide the sheet 3 to the transfer position smoothly.

Since the geometric moment of inertia $I_1$ of the first guide member 71 is set to be larger than the geometric moment of inertia $I_2$ of the second guide member 72, the first guide member 71 is stronger than the second guide member 72. Accordingly, when the thin sheet 3 is guided, the front end of the thin sheet 3 can be guided to a position as close as possible to the photosensitive drum 27 by the use of the first guide member 71. Accordingly, it is possible to prevent occurrence of electric discharge on the thin sheet 3.

The second guide member 72 weaker than the first guide member 71, so that the second guide face 72A may apply a relatively weak pressing force to the sheet 3 toward the photosensitive drum 27 to have a relatively small friction between the sheet 3 and the second guide face 72A. Accordingly, the thick sheet 3 is more correctly guided toward the transfer position, so that the transfer defect may be more prevented from occurring due to bending of the thick sheet 3. In addition, the transfer defect may be more prevented from occurring due to the vibration on the sheet 3 resulted from the friction between the sheet 3 and the second guide member 72.

A length from the first leading end 74 to the first base end 73 of the first guide face 71A is longer than a length from the second leading end 76 to the second base end 75 of the second guide face 72A, however, the second guide face 72A is disposed closer to the transfer position than the first guide face 71A, so that the second leading end 76 may be sufficiently disposed closer to the photosensitive drum 27 even when the second guide face is shorter than the first guide face 71A. Accordingly, the sheet 3 may be smoothly guided to the transfer position.

In addition, a product $E_1I_1$ between the geometric moment of inertia $I_1$ and the expanding modulus of elasticity $E_1$ of the first guide member 71 is in a range of $3.49\times10^{-5}\leqq E_1I_1\leqq1.18\times10^{-3}$, and a product $E_2I_2$ between the geometric moment of inertia $I_2$ and the expanding modulus of elasticity $E_2$ Of the second guide member 72 is in a range of $3.49\times10^{-5}\leqq E_2I_2\leqq1.18\times10^{-3}$, so that the each of the first guide member 71 and the second guide member 72 may be better bent in response to a thickness of the sheet 3. Accordingly, the sheet 3 may be smoothly guided to the transfer position.

When the contact angle θ1 between the photosensitive drum 27 and the sheet 3 guided by the first guide member 71 is 90°, the front end of the sheet 3 is jammed when the sheet 3 is in contact with the photosensitive drum 27, and when the contact angle θ1 exceeds 90°, the sheet is guided toward the opposite side to the transport location with respect to the contact portion. However, the first guide member 71 is disposed in a location having the contact angle θ1 less than 90° between the photosensitive drum 27 and the sheet 3. Accordingly, when the sheet 3 is in contact with the photosensitive drum 27, the sheet is guided so that the contact angle θ1 between the photosensitive drum 27 and the sheet 3 is less than 90°, so that the sheet 3 may be smooth guided toward the transfer position.

Further, the first guide face 71A and the second guide face 72A are composed of sagged surfaces formed by press working, so that the sheet 3 may be smoothly guided without hanging over the edges 65 of the first guide face 71A and the second guide face 72A.

Figure 20:
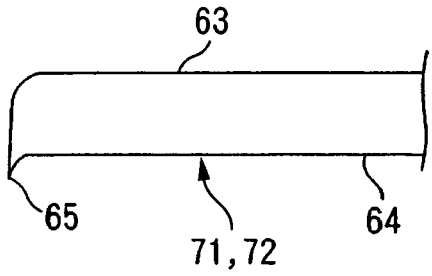
FIG. 20 is a side cross-sectional view illustrating a main part of the front end of the first and second guide members.

That is, when the first guide member 71 and the second guide member 72 are formed by press working, the end 65 of the rear surface 64 at the opposite side to the surface 63 composed of the sagged surface is cut by a shearing force of the cutting blade at the time of press molding to be protruded (i.e., burr) as shown in FIG. 20. And when such rear surface 64 is disposed as the top surface (the first guide face 71A and the second guide face 72A) in contact with the sheet 3, the sheet 3 is stuck in the protruded end 65 (burr) so that the smooth transport may not be accomplished.

However, according to this process cartridge 17, the surface 63 composed of the sagged surface by press working becomes the top surface and the area surface 64 opposite to the surface 63 becomes the bottom surface, and the bottom surface opposes to the top surface of the maintaining unit 57, that is, the rear surface 64 is not in contact with the sheet 3 as described above, so that the sheet 3 may be smoothly guided without hanging over the edge 65 of the rear surface 64.

In addition, the transfer roller 30 is included in the process cartridge 17, so that the first guide member 71 and the second guide member 72 may have the relative location with respect to the transfer position with good accuracy. Accordingly, the transfer defect may be prevented from occurring in any of the thin and thick sheets 3.

The edge of the first leading end 74 of the first guide face 71A is disposed higher than the line L connecting the contact position between the photosensitive drum 27 and the transfer roller 30 to the contact position between two resist rollers 12, so that the sheet 3 may be guided toward the upstream side of the transfer position in the rotation direction of the photosensitive drum 27. Accordingly, the discharge shape due to the discharge of the thin sheet 3 may be surely prevented from occurring.

The first and second guide members 71 and 72 are formed of the insulating material like a resin film, so that the electric conduction through the sheet 3 from the photosensitive drum 27 may be prevented from occurring. Accordingly, the transfer of the toner image may be surely accomplished.

In addition, the first base end 73 of the first guide member 71 and the second base end 75 of the second guide member 72 are fixed to the case 51, so that the photosensitive drum 27, the first and second guide members 71 and 72 may be maintained as one body by the case 51, which thus allows the first and second guide faces 71A and 72A to be surely disposed with respect to the photosensitive drum 27.

As shown in FIG. 15B, when the first guide member 71 and the second guide member 72 are divided in their width directions, the friction resistance at the time of carrying the sheet 3 may be reduced in the first guide member 71 and the second guide member 72, so that the smooth guiding may be accomplished.

Modified Illustrative Aspect

Figure 21:
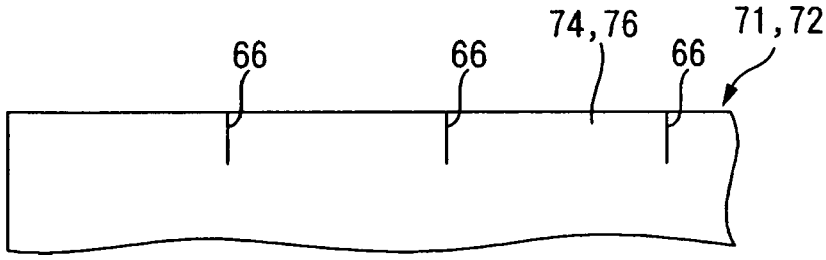
FIG. 21 is a schematic plan view illustrating different structures (i.e. notch shapes) of the first and second guide members.

FIG. 21 is a schematic plan view illustrating another structure of the first guide member 71 and the second guide member 72. A plurality of notches 66 are formed in parallel with each other and spaced apart from each other by the substantially same interval in the width direction orthogonal to the conveying direction of the sheet 3 in the first leading end 74 of the first guide member 71 and the second leading end 76 of the second guide member 72. Each notch 66 extends on its intermediate way toward the first base end 73 or the second base end 75 from the edge of the first leading end 74 or the edge of the second leading end 76 along the conveying direction of the sheet 3 (see FIG. 14).

By forming such notches 66, the first guide member 71 and the second guide member 72 may be mounted on the maintaining unit 57 (see FIG. 14) with good accuracy without having the crease on the first guide member 71 and the second guide member 72.

That is, the first guide member 71 and the second guide member 72 are thin and elongated along their width directions, so that a deviation occurs in locations of the central portions of the width directions of the first guide member 71 and the second guide member 72 when both ends of the width direction of the first guide member 71 and the second guide member 72 are aligned with respect to and mounted (connected) on the maintaining unit 57. In addition, when one ends of the width direction of the first guide member 71 and the second guide member 72 are aligned with respect to the maintaining unit 57 and are mounted toward the other ends of the width direction from the one ends in order, the deviation of the locations of the central portions of the width directions of the first guide member 71 and the second guide member 72 may be avoided, however, the first guide member 71 and the second guide member 72 are apt to have a crease.

According to the first guide member 71 and the second guide member 72 of the present illustrative aspect, a plurality of notches 66 are formed therein, so that the crease, which occurs when the first guide member 71 and the second guide member 72 are mounted on the maintaining unit 57 from their one ends of the width direction in order, may be absorbed by each notch 66. Accordingly, first guide member 71 and the second guide member 72 may be mounted on the maintaining unit 57 with good accuracy without having the crease on the first guide member 71 and the second guide member 72.

In addition, the first leading end 74 of the first guide member 71 and the second leading end 76 of the second guide member 72 are divided into a plurality of parts in their width directions by the notch 66, so that the first guide member 71 and the second guide member 72 may be made to be bent only in a portion in contact with the sheet 3 at the time of continuously carrying the sheet 3 having a narrow width. Accordingly, when the sheet 3 having a narrow width is continuously transported, the entire first and second guide members 71 and 72 may be prevented from bending in response to the bending of the portion in contact with the sheet 3, and reliability about the durability of the first guide member 71 and the second guide member 72 may be enhanced.

In addition, only one notch 66 may be formed in the first leading end 74 of the first guide member 71 or the second leading end of the second guide member 72. In addition, when a plurality of notches 66 are formed, each interval between the notches 66 may not be necessarily substantially the same in the width direction, but may be different. For example, to comply with various sizes of the sheet 3 available in the laser printer 1, the notch 66 may be formed in locations corresponding to both edges of the width direction of the sheet 3 having various sizes to be transported onto the first guide member 71 or the second guide member 72 in the first leading end 74 of the first guide member 71 or the second leading end 76 of the second guide member 72. In this case, the first guide member 71 or the second guide member 72 may be made to be bent only in a portion in contact with the sheet 3 at the time of carrying the sheet 3.

Figure 22:
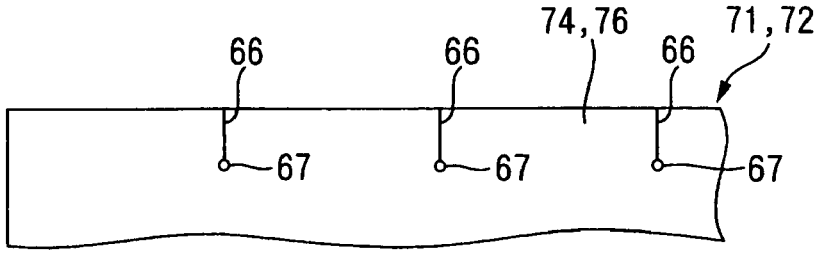
FIG. 22 is a schematic plan view illustrating separation stoppers formed in ends of different structures (i.e. notch shapes) of the first and second guide members.

FIG. 22 is a schematic plan view illustrating another structure of the first guide member 71 and the second guide member 72. Referring to FIG. 22, same reference numerals as those of FIG. 21 are given to the parts corresponding to the parts shown in FIG. 21, and the detailed description thereof will be skipped below.

A separation stopper 67 is formed at an end of the first base end 73 or the second base end 75 of each notch 66 in the first guide member 71 and the second guide member 72 shown in FIG. 22. The separation stopper 67 is formed as a substantially circular hole when seen its plan view at the end of each notch 66, and penetrates from the top surfaces of the first guide member 71 and the second guide member 72 in contact with the sheet 3 to the bottom surface of the opposite side along the conveying direction of the sheet 3.

Accordingly, first guide member 71 and the second guide member 72 may be prevented from being separated from the end of each notch 66.

FIGS. 23A-23D are schematic plan views illustrating another structure of the first guide member 71 and the second guide member 72. A plurality of slits 68 are disposed in parallel with each other by a substantially same interval in the width direction orthogonal to the conveying direction of the sheet in the first leading end 74 and the second leading end 76 of the first guide member 71 and the second guide member 72 shown in FIGS. 23A-23D, respectively. Each slit 68 extends on its intermediate way toward the first base end 73 or the second base end 75 from the edge of the first leading end 74 or the edge of the second leading end 76 along the conveying direction of the sheet 3 (see FIG. 14).

By forming the plurality of slits 68, as the is the same case as the notch 66, the first guide member 71 and the second guide member 72 may be mounted on the maintaining unit 57 with good accuracy without having the crease on the first guide member 71 and the second guide member 72. In addition, when the sheet 3 having a narrow width is continuously transported, the entire first and second guide members 71 and 72 may be prevented from bending in response to the bending of the portion in contact with the sheet 3, and reliability about the durability of the first guide member 71 and the second guide member 72 may be enhanced.

Further, the slit 68, unlike the notch 66, has a width in a direction orthogonal to the conveying direction of the sheet 3, so that the portion between the first and second guide members 71 and 72 with the slit 68 interposed therebetween may be more prevented from overlapping each other when the first and second guide members 71 and 72 are mounted on the maintaining unit 57.

Figure 23A:
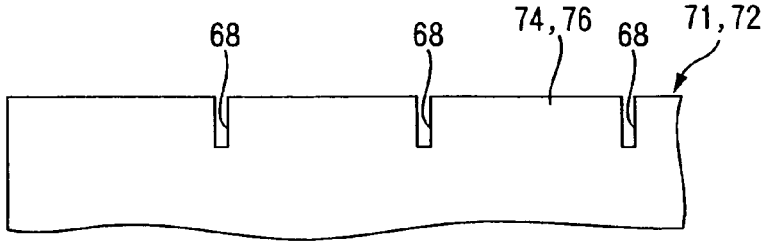
Figure 23B:
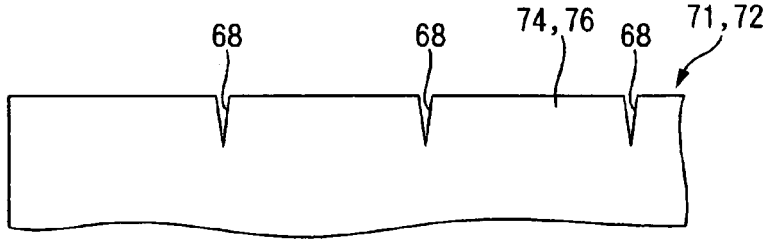
Figure 23C:
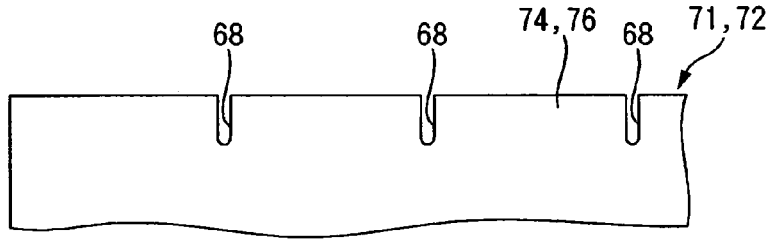

In addition, each slit 68 may be substantially rectangular when seen its plan view as shown in FIG. 23A, may be substantially V-shaped when seen its plan view as shown in FIG. 23B, and may be substantially U-shaped when seen its plan view as shown in FIG. 23C.

When each slit 68 is substantially rectangular or is substantially U-shaped when seen its plan view, the first guide member 71 and the second guide member 82 may be prevented from being separated from the end of the first base end 73 or the second base end 75 of each slit 68 (see FIG. 14).

In addition, when each slit 68 is substantially V-shaped when seen its plan view, a portion between the first and second guide members 71 and 72 with the slit 68 interposed therebetween is far away toward the front end from the rear end, so that the portion between the first and second guide members 71 and 72 with the slit 68 interposed therebetween may be more prevented from overlapping each other when the first and second guide members 71 and 72 are mounted on the maintaining unit 57.

Figure 23D:
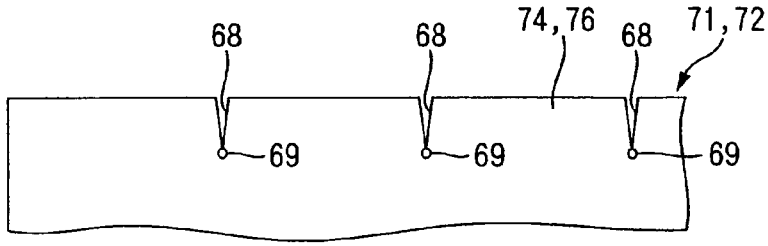

In this case, as shown in FIG. 23D, a separation stopper 69 is preferably formed at an end of the first base end 73 or the second base end 75 of the slit 68. The separation stopper 69 is formed as a substantially circular hole when seen its plan view at the end of each slit 68, and penetrates from the top surface of the first guide member 71 and the second guide member 72 in contact with the sheet 3 to the bottom surface of the opposite side along the conveying direction of the sheet 3. By forming the separation stopper 69, the first guide member 71 and the second guide member 82 may be prevented from being separated at the deepest part of each slit 68.

In addition, slit 68 may be disposed only one in the first leading end 74 of the first guide member 71 or the second leading end 76 of the second guide member 72. In addition, when a plurality of slits 68 are formed, each interval between the slits 68 may not be necessarily substantially the same in the width direction, but may be different. For example, to comply with various sizes of the sheet 3 available in the laser printer 1, the slit 68 may be formed in locations corresponding to both edges of the width direction of the sheet 3 having various sizes to be transported onto the first guide member 71 or the second guide member 72 in the first leading end 74 of the first guide member 71 or the second leading end 76 of the second guide member 72. In this case, the first guide member 71 or the second guide member 71 may be made to be bent only in a portion in contact with the sheet 3 at the time of carrying the sheet 3.

Figure 24:
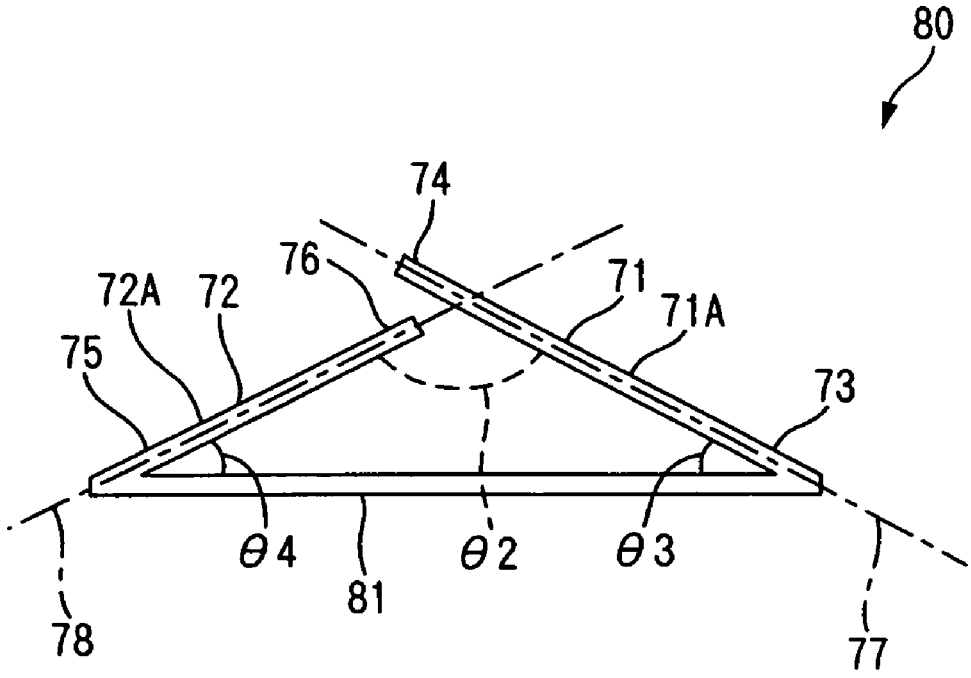
FIG. 24 is a perspective view illustrating different structures of the first and second guide members 71 and 72 (of which the first and second guide members are formed as one plate member)

FIG. 24 is a side view of another configuration of the first and second guide members 71 and 72.

In FIG. 24, the first and second guide members 71 and 72 are made of a flexible insulation material, for example, a resin such as polyethyleneterephthalate, and are formed of a sheet of plate member 80 such as a film member formed in a square shape by press working.

The first guide member 71 is formed to be inclined by bending the front end of the plate member 80 toward one side (upside) and a downstream side. The second guide member 72 is formed to be inclined by bending the rear end of the plate member 80 toward one side (upside) and an upstream side. That is, the plate member 80 includes the first guide member 71, the second guide member 72, and a connection part 81, which are integrally formed with one another. In this case, the first guide member 71 is formed to be upwardly inclined from upstream to downstream, and its first leading end 74 is provided to be adjacent to the photosensitive drum 27. The second guide member 72 is formed to be upwardly inclined from upstream to downstream, and its front tip part 76 is provided to be separated from the first leading end 74 at a lower side of the first leading end 74 of the first guide member 71. The connection part 81 connects the first leading end 73 of the first guide member 71 and the second base end 75 of the second guide member 72 to each other. The upper surface of the first guide member 71 forms the first guide face 71A for guiding the sheet 3 toward the photosensitive drum 27. The upper surface of the second guide member 72 forms the second guide face 72A for guiding the sheet 3 toward the photosensitive drum 27.

The lower surface of the connection part 81 is fixed to contact the upper surface of the supporting part 57 in the plate member 80, such that the first base end 73 of the first guide member 71 and the second base end 75 of the second guide member 72 are fixed at an upstream side of the transfer position. A tilt angle θ3 of the first guide member 71 to the connection part 81 and a tile angle θ4 (see FIG. 17C) of the second guide member 72 to the connection part 81 are preferably about 30° to 45° and 30°, respectively. Since both the tilt angle θ3 of the first guide member 71 to the connection part 81 and the tile angle θ4 of the second guide member 72 to the connection part 81 are set to be smaller than 45°, a plane 77, which is formed by connecting the first leading end 74 and the first base end 73 of the first guide member 71, and a plane 78, which is formed by connecting the second leading end 76 and the second base end 75 of the second guide member 72, cross each other to form an obtuse angle θ2 therebetween.

The second leading end 76 of the second guide member 72 may be provided to contact the first leading end 74 of the first guide member 71. In addition, the second leading end 76 of the second guide member 72 may be provided to be separated from or contact the first leading end 74 on the downstream side (on the photosensitive drum 27 side) of the first leading end 74 of the first guide member 71.

Similarly to the first and second members 71 and 72 according to the above-mentioned illustrative aspect, since the first leading end 74 of the first guide member 71 and the second leading end 76 of the second guide member 72 face each other in the plate member 80, it is possible to smoothly guide the thin sheet 3 and the thick sheet 3 to the transfer position, thereby preventing a transfer failure.

In addition, in the plate member 80, the first base end 73 of the first guide member 71 and the second base end 75 of the second guide member 72 are connected by the connection part 81 to each other, such that the first and second guide members 71 and 72 are integrally formed with each other. Accordingly, it is possible to reduce the number of components, or to easily mount the first and second guide members 71 and 72.

In addition, in the plate member 80, the first leading end 74 of the first guide member 71 and the second leading end 76 of the second guide member 72 may include the configurations as shown in FIGS. 21-23D.

Third Illustrative Aspect

Hereinafter, a laser printer 1 according to a third illustrative aspect will be described with reference to the drawings.

In the following description and drawings for the third illustrative aspect, parts the same as those in the first and the second illustrative aspects are denoted by the same reference numerals as those in the first illustrative aspect, and detailed description of the parts and configurations the same as those in the first and the second illustrative aspects will be omitted.

Figure 25:
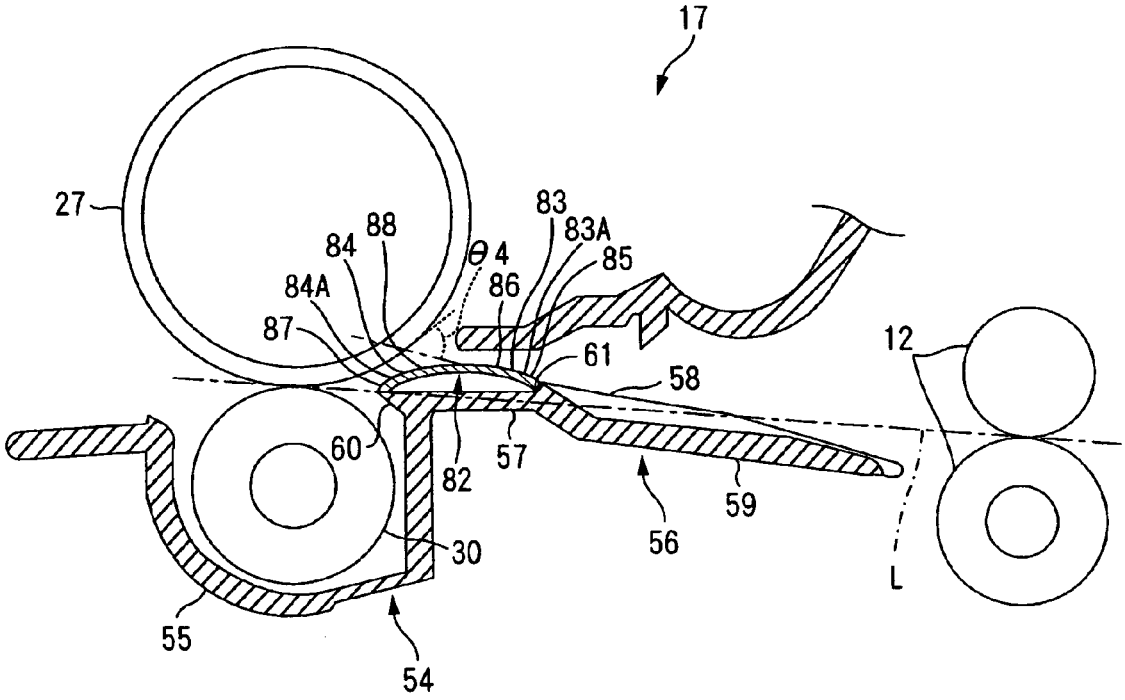
FIG. 25 is a side sectional view of a main part of a process cartridge of the laser printer according to a third illustrative aspect which is configured that the first and second guide members are integrally formed with each other.

As shown in FIG. 25, the process cartridge 17 according to the third illustrative aspect is configured that the first guide member 83, which is upwardly inclined from upstream to downstream and whose front end, a first leading end 86, is provided adjacent to the photosensitive drum 27, and a second guide member 84, which is upwardly inclined from upstream to downstream and whose rear end, a second leading end 88, faces to be continuously formed with the first leading end 86 of the first guide member 83, are integrally formed with each other by a sheet of plate member 82. The plate member 82 is made of a flexible insulation material, for example, a resin such as polyethylene-terephthalate, and is formed of a film member formed in a square shape by press working. The front and rear ends (the first and second base ends 85 and 87) of the plate member 82 are fixed to the upper surface of the supporting part 57, such that the plate member 82 is formed in a circular arc shape with its central portion curved upward.

The first guide member 83 includes the first base end 85, which is fixed on a step part 61 of the supporting part 57, and a first guide face 83A for guiding the sheet 3 to the photosensitive drum 27. The first guide member 83 extends from the first base end 85 to the photosensitive drum 27.

The second guide member 84 includes the second base end 87, which is fixed at an upper surface of an extended part 60 formed on the front end of the supporting part 57, and a second guide face 84A for guiding the sheet 3 to the photosensitive drum 27. The second guide member 84 extends from the second base end 87 toward an upstream side.

When a portion contacted by a blade of a cutter is referred to as a surface and the opposite side is referred to as the other surface in press working, the plate member 82 is provided such that the surface is disposed to be an upper side (the first guide face 83A and second guide face 84A) that contacts the sheet 3, and the other surface is disposed to be a lower side that faces an upper side of the supporting part 57.

The first leading end 86 of the first guide face 83A and the second leading end 88 of the second guide face 84A are provided at an upper side of a line L formed by connecting a contact position (transfer position) between the photosensitive drum 27 and the transfer roller 30 and a contact position between two resist rollers 12 facing each other.

The first guide member 83 can set the contact position of the front end of the sheet 3 with the photosensitive drum 27 by using bending of the first leading end 86, and is provided at a guidable position such that a contact angle θ4 between the photosensitive drum 27 and the sheet 3 is θ4<90°.

The plate member 82 is formed such that the product EI of Young's modulus E, which is modulus of elasticity in a direction parallel to a conveying direction of the sheet 3, and the geometric moment of inertia I, which has a direction parallel to the axial direction of the photosensitive drum 27 and a direction perpendicular to a widest surface (upper or lower surface), is $3.49\times10^{-5} \leqq EI \leqq 1.18\times10^{-3}$.

A tilt angle θ5 (see FIG. 27C) of the first guide member 83 to the supporting part 57 and a tile angle θ6 (see FIG. 27C) of the second guide member 84 to the supporting part 57 are preferably about 30° to 45° and 30°, respectively.

Figure 27A:
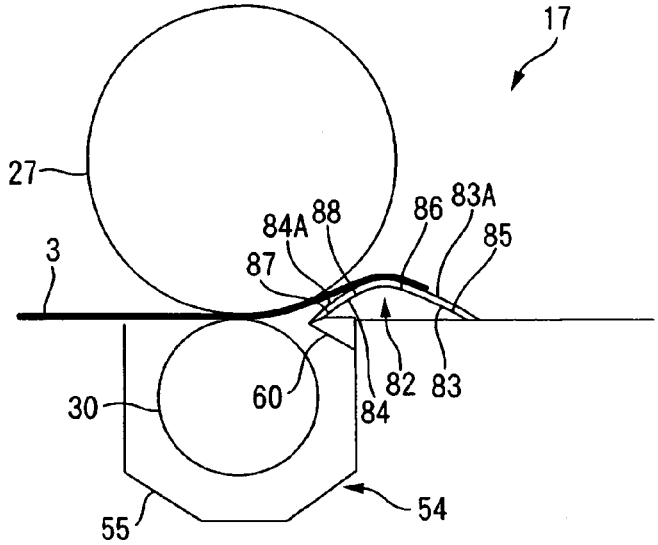
Figure 27B:
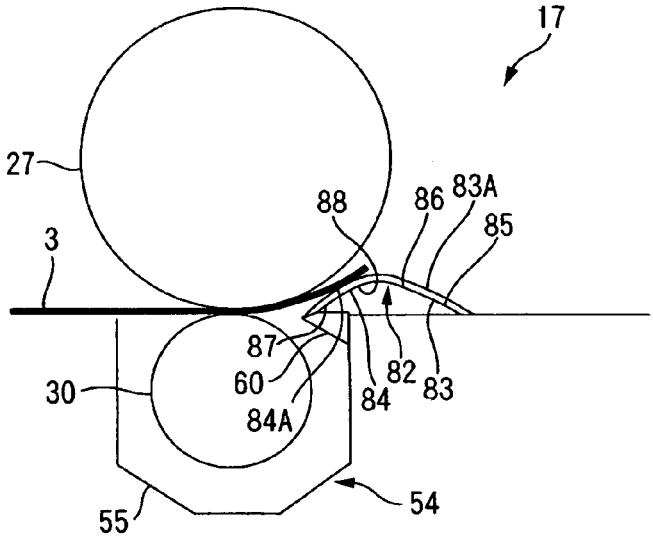
Figure 27C:
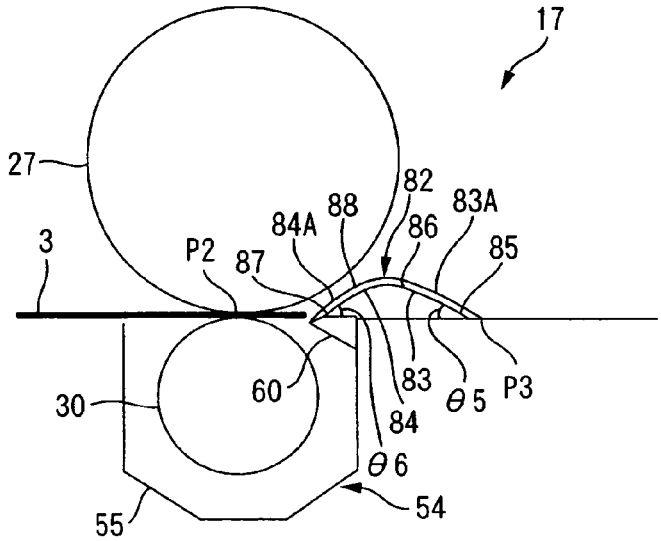

In addition, the tilt angles θ5 and θ6 may be an angle about a line formed by connecting a direct upstream side P3 of the first guide member 83 and a transfer position P2 with each other on a sheet conveying path (see FIG. 27C). The tilt angles θ5 and 06 may be angles about a line formed by connecting an edge of the first base end 85 of the first guide member 83 and an edge of the second base end 87 of the second guide member 84 with each other.

In the process cartridge 17 configured in such a manner, a detailed description of a process for guiding the thin sheet 3 and the thick sheet 3 to a transfer position by means of the first and second guide members 83 and 84 will be given.

Figure 26A:
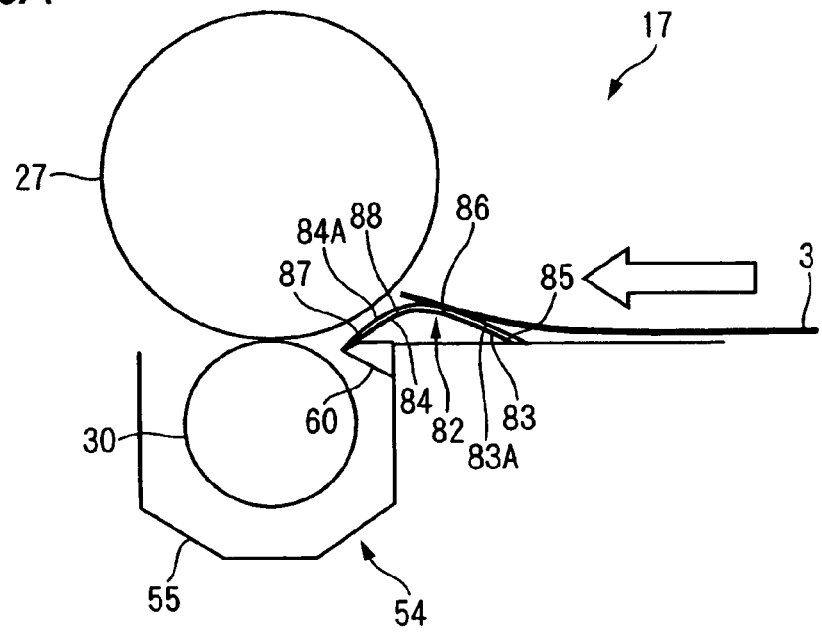

Operation of Guiding a Thin Sheet to a Transfer Position by Means of the First and Second Guide Members FIGS. 26A-27C show operation of guiding a thin sheet 3 to a transfer position step by step by means of the first and second guide members 83 and 84. As shown in FIG. 26A, in the process cartridge 17, when the thin sheet 3 is carried in, the front end part of the sheet 3 is guided to a downstream side along the first guide face 83A of the first guide member 83, is carried from the first base end 85 to the first leading end 86 of the first guide face 83A, and is guided to contact an upstream side of the transfer position on the photosensitive drum 27.

Figure 26B:
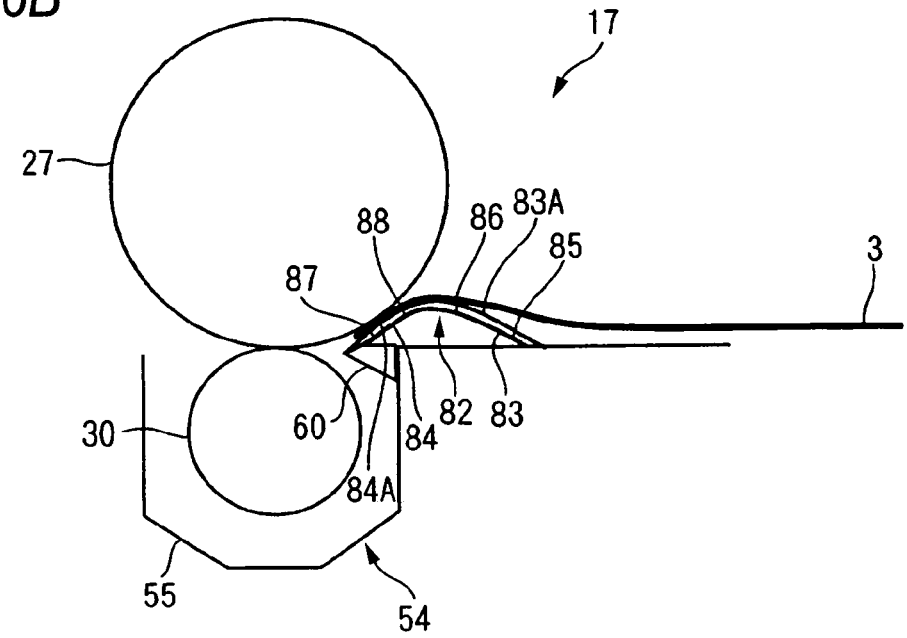

However, as shown in FIG. 26B, the thin sheet 3 is not hard. Thus, even though the front end part of the thin sheet 3 contacts the photosensitive drum 27, the first leading end 86 of the first guide member 83 and the second leading end 88 of the second guide member 84 are not bent very much, such that the thin sheet 3 closely contacts the photosensitive drum 27 and is guided to the transfer position.

Next, as shown in FIG. 26A, the thin sheet 3 closely contacts the photosensitive drum 27 at an upstream side of the transfer position and is guided to the transfer position from the front end to the rear end. Thus, since a gap is not formed between the thin sheet 3 and the photosensitive drum 27 at the upstream side of the transfer position, it is possible to prevent occurrence of electric discharge therebetween. As a result, it is possible to prevent occurrence of a discharge shape having a spot shape in the thin sheet 3, which is called as 'penetration'.

In addition, when the thin sheet 3 is guided by the first guide member 83 from the front end to the rear end, a lower side of the thin sheet 3 may slide on the second guide face 84A of the second guide member 84 and be guided to the transfer position, or may not slide on the second guide face 84A of the second guide member 84 and be guided to the transfer position.

The first leading end 86 of the first guide face 83A is continuous with the second leading end 88 of the second guide face 84A on the downstream side. Thus, when the rear end of the thin sheet 3 passes through the first part 86 of the first guide face 83A, the rear end of the thin sheet 3 is elastically received by the second guide face 84A and is guided to the transfer position, as shown in FIGS. 27B and 27C. Therefore, it is possible to prevent the rear end of the thin sheet 3 from shaking and to smoothly guide the thin sheet 3 to the transfer position, thereby preventing a transfer failure.

Figure 28A:
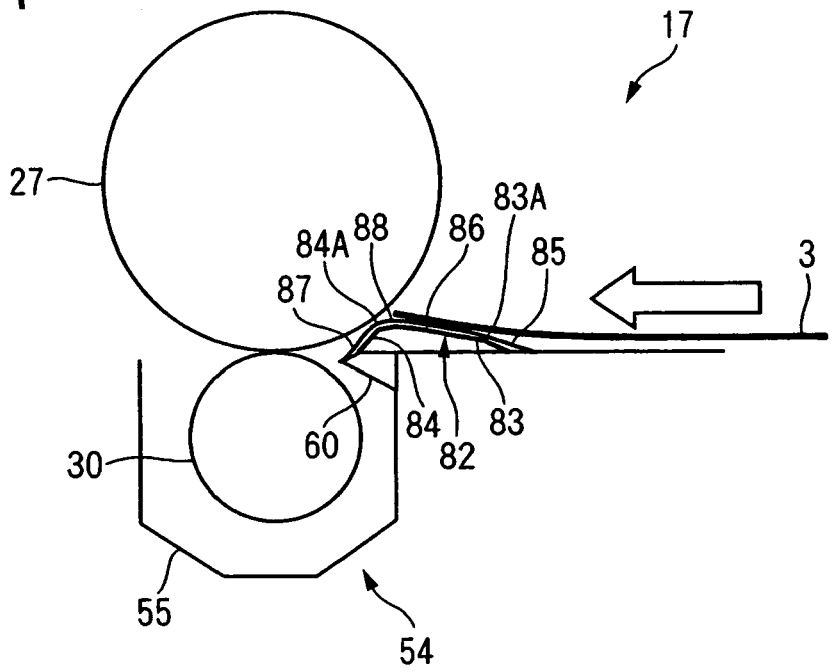

Operation of Guiding a Thin Sheet to a Transfer Position by Means of the First and Second Guide Members FIGS. 28A-29C show operation of guiding a thick sheet 3 to a transfer position step by step by means of the first and second guide members 83 and 84. As shown in FIG. 28A, in the process cartridge 17, when the thick sheet 3 is carried in, the front end part of the sheet 3 is guided to a downstream side along the first guide face 83A of the first guide member 83, is carried from the first base end 85 to the first leading end 86 of the first guide face 83A, and is guided to contact an upstream side of the transfer position on the photosensitive drum 27.

Figure 28B:
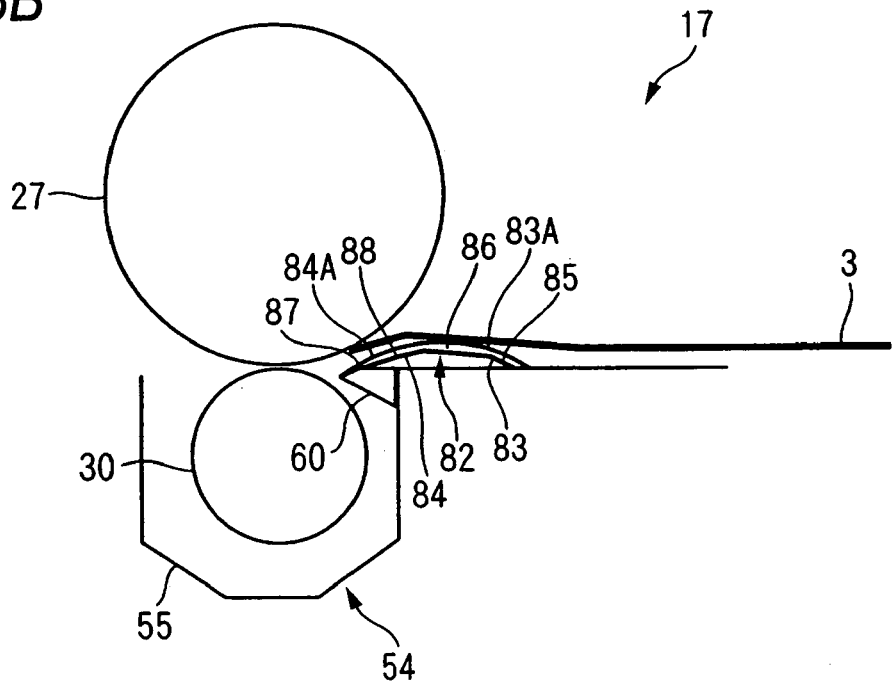

At this time, as shown in FIG. 28A, as the front end of the thick sheet 3 is carried to the photosensitive drum 27, the first leading end 86 of the first guide member 83 and the second leading end 88 of the second guide member 84 are bent downward due to the weight of the thick sheet 3. In addition, as shown in FIG. 28B, the thick sheet 3 is hard. Thus, when the front end part of the thick sheet 3 contacts the photosensitive drum 27, the first leading end 86 of the first guide member 83 and the second leading end 88 of the second guide member 84 are greatly bent in a bow shape, such that the thick sheet 3 is guided in a close contact with the photosensitive drum 27.

The second guide face 84A extends to a direction opposite to an extending direction of the first guide face 83A, and the second front tip part 88 is continuous with the first leading end 86 of the first guide face 83A. Thus, as shown in FIG. 28B, when the thick sheet 3 is guided from the first guide face 83A to the second guide face 84A, it contacts the second guide face 84A from the second leading end 88 to the second base end 87. The thick sheet 3 is pressurized by the second guide face 84A from a direction approaching the photosensitive drum 27 toward a downstream side. Thus, as the sheet 3 is carried to the transfer position, it is possible to greatly bend the second leading end 88 with respect to the second base end 87 on the second guide face 84A.

Figure 29A:
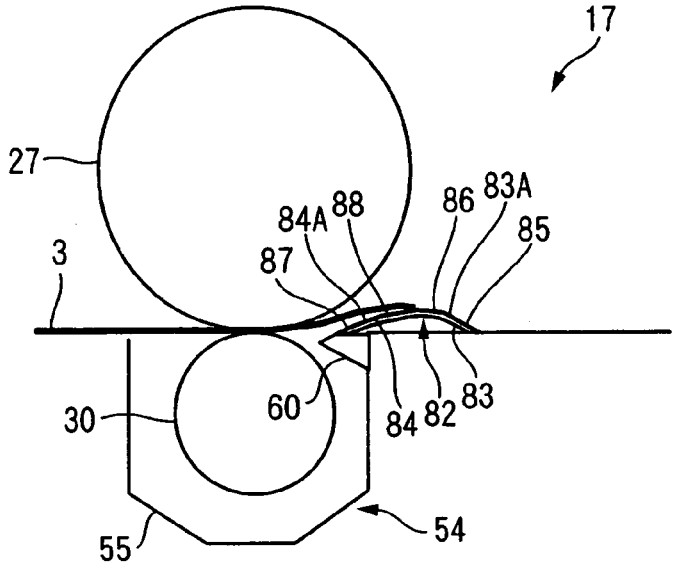

Thus, as shown in FIG. 29A, since the thick sheet 3 is guided to a relatively right transfer position, it is possible to prevent a transfer failure due to bending of the thick sheet 3. In addition, since it is possible to reduce friction at the time when the sheet 3 contacts the second guide face 84A, it is possible to reduce vibration of the sheet 3 due to the friction between the second guide face 84A and the sheet 3. Accordingly, it is possible to prevent occurrence of a transfer failure due to the vibration.

In addition, even though there is a gap between the thick sheet 3 and the photosensitive drum 27, it is difficult for electric discharge to occur compared with the thin sheet 3. Accordingly, even though the thick sheet 3 is guided to a relatively right transfer position, it is difficult for a discharge shape to be produced.

Figure 29B:
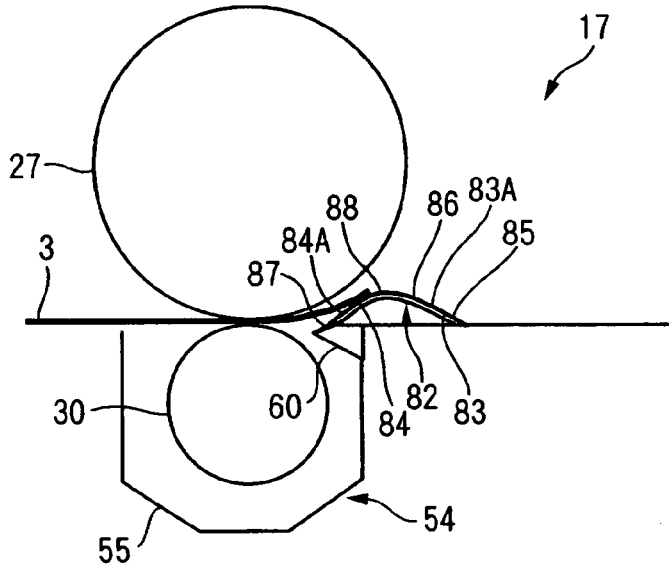
Figure 29C:
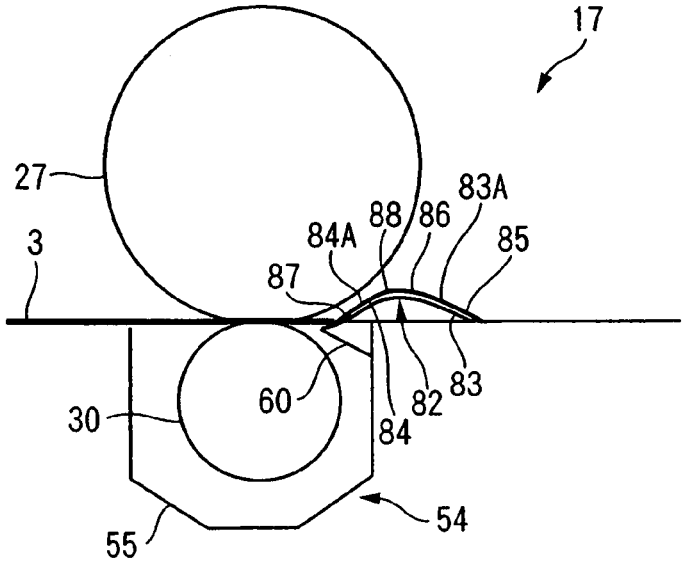

As shown in FIGS. 29A and 29B, the first guide face 83A of the first guide member 83 and the second guide face 84A of the second guide member 84 are continuous with each other. Thus, after the rear end of the thick sheet 3 is guided to the transfer position, the sheet 3 is continuously carried from the first leading end 86 of the first guide face 83A to the second guide face 84A and is guided to the transfer position as shown in FIG. 29C. Accordingly, it is possible to prevent fluttering of the rear end of the thick sheet 3 and to smoothly guide the thick sheet 3 to the transfer position, thereby preventing a transfer failure.

That is, since the process cartridge 17 uses a sheet of plate member 82 formed of a flexible film member, it can smoothly guide the thin or thick sheet 3 to the transfer position. Therefore, it is possible to prevent a transfer failure. In addition, since an image is formed on a sheet by the use of the laser printer 1 equipped with the process cartridge 17, it is possible to form a stable image.

In particular, since the first leading end 86 of the first guide member 83 and the second front tip part 88 of the second guide member 84 are continuous with each other in the process cartridge 17, it is possible to guide the sheet 3 continuously. Thus, it is possible to securely guide the sheet 3 to the transfer position without a transfer failure.

In addition, since the product EI of Young's modulus E and the geometric moment of inertia I in the plate member 82 is $3.49\times10^{-5}\leqq EI\leqq1.18\times10^{-3}$, the first and second guide members 83 and 84, which are integrally formed with each other, can be satisfactorily bent depending on the thickness of the sheet 3. Accordingly, it is possible to smoothly guide the sheet 3 to the transfer position.

In addition, the geometric moment of inertia $I_1$ of the first guide member 71 may be set to be greater than the geometric moment of inertia $I_2$ of the second guide member 72. For example, the first guide member 71 may be formed to be thicker than the second guide member 72. Alternatively, a length in width of the first guide member 71 may be formed to be longer than that of the second guide member 72.

In a case where a contact angle θ4 between the sheet 3 guided by the first guide member 83 and the photosensitive drum 27 is 90°, the front end of the sheet 3 is jammed when the sheet 3 contacts the photosensitive drum 27. When the contact angle θ4 exceeds 90°, the sheet 3 is guided to an opposite side of the transfer position. However, the first guide member 83 is provided such that the contact angle θ4 between the sheet 3 and the photosensitive drum 27 is θ1<90°. Thus, since the sheet 3 is guided such that the contact angle θ4 between the sheet 3 and the photosensitive drum 27 is less than 90° when the sheet 3 contacts the photosensitive drum 27, it is possible to smoothly guide the sheet 3 to the transfer position.

In addition, since the first and second guide faces 83A and 84A are a sag surface of press working, it is possible to smoothly guide the sheet 3 without being caught on edges of the first and second guide faces 83A and 84A.

In addition, since the transfer roller 30 is included in the process cartridge 17, a relative position between the first and second guide members 83 and 84 and the transfer position can be maintained in a very high accuracy. Accordingly, it is possible to prevent occurrence of a transfer failure in the thin sheet 3 or thick sheet 3.

Since the first leading end of the first guide face 83A is provided at an upper side of a line L formed by connecting a contact position between the photosensitive drum 27 and the transfer roller 30 and a contact position between two resist rollers 12, it is possible to guide the sheet 3 toward an upstream side of the transfer position in a rotating direction of the photosensitive drum 27. Thus, it is possible to securely prevent occurrence of a discharge shape due to electrical discharge of the thin sheet 3.

Since the first and second guide members 83 and 84 are made of an insulation material such as a resin film, it is possible to prevent conduction through the sheet 3 from the photosensitive drum 27. Accordingly, it is possible to achieve a secure transfer of a toner image.

In addition, since the first base end 85 of the first guide member 83 and the second base end 87 of the second guide member 84 are fixed to a casing 51, the photosensitive drum 27, the first guide member 83, and the second guide member 84 can be unitarily provided by the use of the casing 51. Accordingly, it is possible to securely provide the first and second guide faces 83A and 84A with respect to the photosensitive drum 27.

The plate member 82 (the first and second guide members 83 and 84) may be continuously formed in a width direction perpendicular to a conveying direction of the sheet, i.e., in a direction parallel to an axial direction of the photosensitive drum 27. Alternatively, the plate-like members 82 may be divided into a plurality of parts and be provided parallel at predetermined intervals in a direction perpendicular to the conveying direction of the sheet 3.

When the first and second guide members 83 and 84 are divided in a width direction, it is possible to reduce friction resistance on the first and second guide members 83 and 84 when the sheet 3 is carried, thereby smoothly guiding the sheet 3.

The second base end 87 of the second guide member 84 may be rotatably fixed. In this configuration, when the thick sheet 3 is guided to the transfer position by the first and second guide members 83 and 84, the thick sheet 3 can be guided to a right transfer position by rotating the second base end 87 of the second guide member 84 so as to correspond to bending of the plate member 82. Accordingly, it is possible to efficiently prevent occurrence of a transfer failure due to the bending of the thick sheet 3.

In addition, the first leading end 86 of the first guide member 83 and the second leading end 88 of the second guide member 84 in the plate member 82 may include the configuration as shown in FIGS. 21-23D. In this case, the notch or the slit may be continuously formed from the first leading end 86 to the second leading end 88.

Modified Example of First and Second Guide Members

Figure 30:
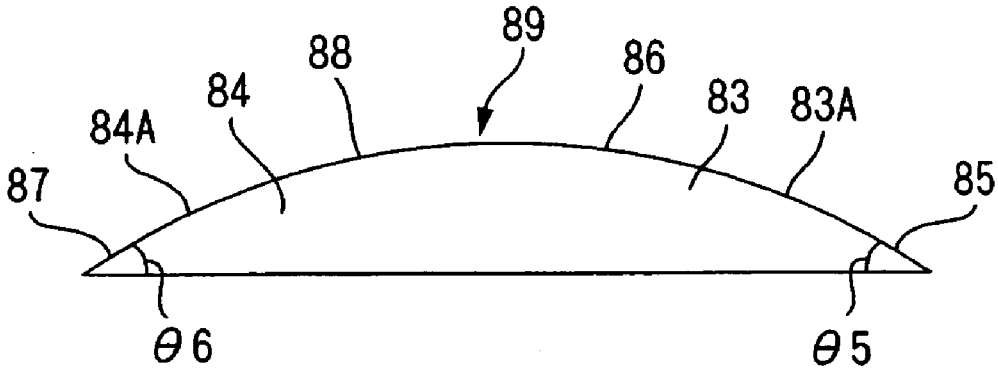
FIG. 30 is a side view illustrating different structures of the first and second guide members 71 and 72 wherein the first and second guide members are formed as single sponge member.
Figure 31A:
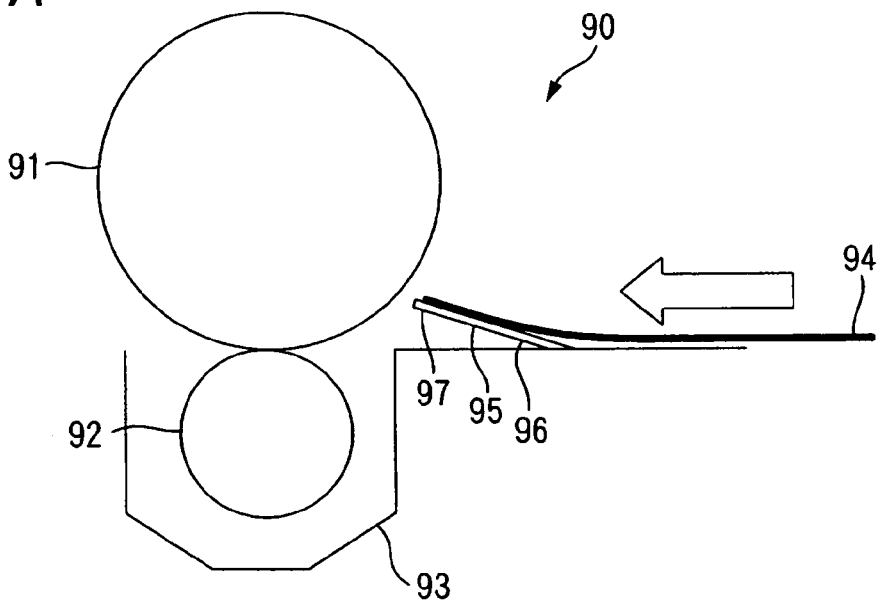
Figure 31B:
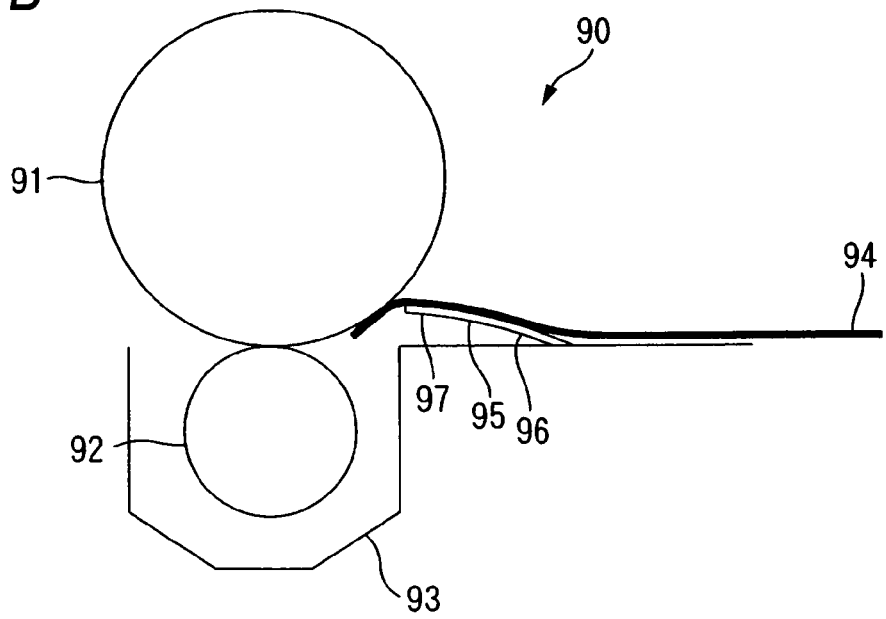
Figure 32A:
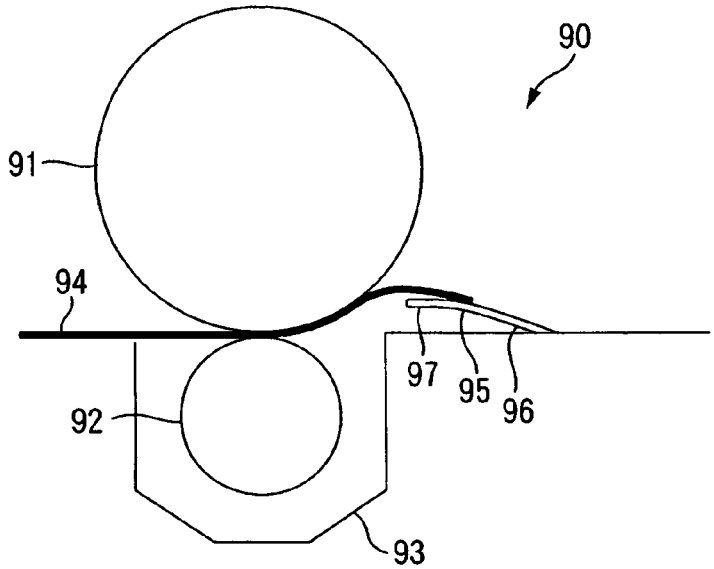
Figure 32B:
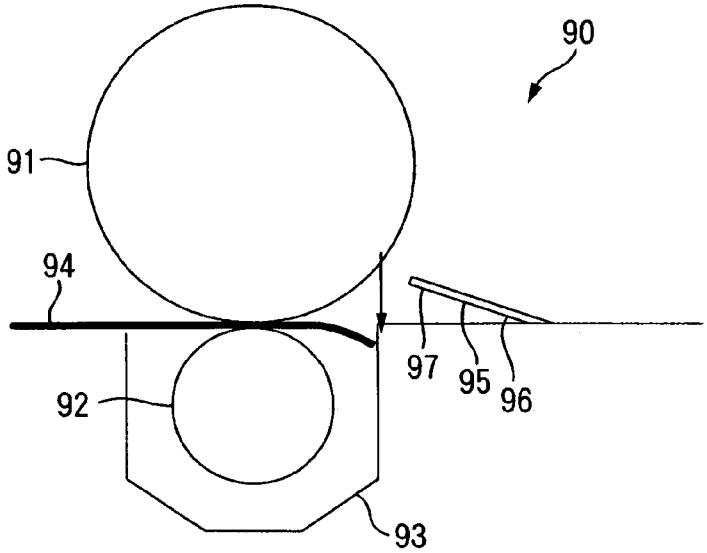
Figure 32C:
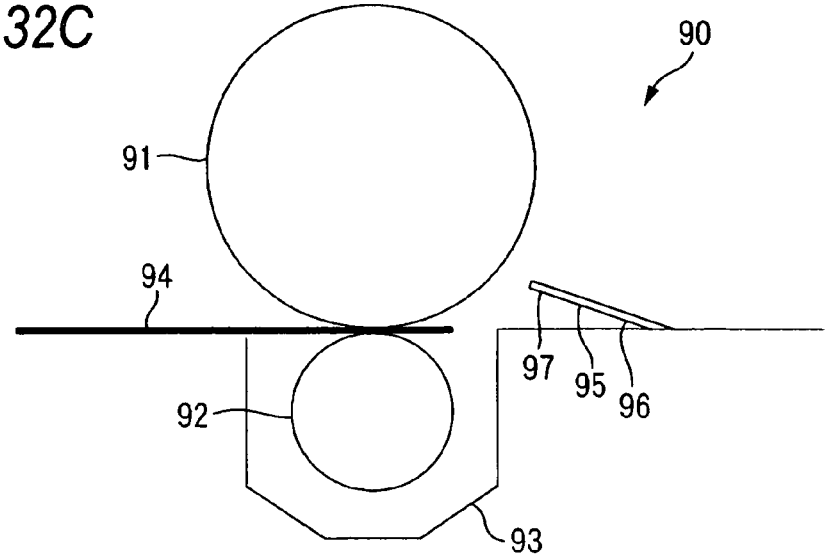

FIG. 30 is a side view of another construction of the first and second guide members 83 and 84.

In FIG. 30, the first and second guide members 83 and 84 are integrally formed with each other and made of a flexible member 89, such as a sponge, that has a semi-oval shape in side view. That is, a lower surface of the flexible member 89 faces an upper surface of the supporting part 57 shown in FIG. 13. An upper surface of the flexible member 89 includes a first guide face 83A and a second guide face 84A at an upstream side and a downstream side, respectively.

The first base end 85 of the first guide face 83A and the second base end 87 of the second guide face 84A are fixed at an upstream side of the transfer position by fixing the lower surface of the flexible member 89 to the upper surface of the supporting part 57. A tilt angle θ5 of the first guide face 83A to the lower surface of the flexible part 89 and a tile angle θ6 of the second guide face 84A to the lower surface of the flexible part 89 are preferably about 30° to 45° and 30°, respectively.

Similarly to the first and second members 83 and 84 according to the above-mentioned illustrative aspect, since the first leading end 86 of the first guide face 83A and the second leading end 88 of the second guide face 84A face each other in the flexible member 89, it is possible to smoothly guide the thin sheet 3 and the thick sheet 3 to the transfer position, thereby preventing a transfer failure.

In addition, even though the transfer roller 30, first guide member 71, second guide member 72, first guide member 83, and second guide member 84 are provided in the process cartridge 17 in the above-mentioned illustrative aspects and modified example, the present invention is not limited thereto. They may be provided in the casing 2.

In the above-mentioned modified example, a combination of the physical properties (geometric moment of inertia, length, product of Young's modulus and geometric moment of inertia, material, and the like) and an arrangement (contact angle between sheet and photosensitive drum, direction of sag surface by press working, and the like) may be applied within the scope of claims.

The foregoing description of the illustrative aspects has been presented for purposes of illustration and description. It is not intended to be exhaustive or to limit the invention to the precise form disclosed, and modifications and variations are possible in light of the above teachings or may be acquired from practice of the invention. The illustrative aspects were chosen and described in order to explain the principles of the invention and its practical application program to enable one skilled in the art to utilize the invention in various illustrative aspects and with various modifications as are suited to the particular use contemplated. It is intended that the scope of the invention be defined by the claims appended hereto, and their equivalents.

What is claimed is:

1. A process cartridge comprising:

an image carrier that carries a developer image that is transferred to a transfer medium at a transfer position;

a first guide member that is provided with a first guide face that guides the transfer medium toward the image carrier, the first guide face having flexibility; and a second guide member that is provided with a second guide face that guides the transfer medium toward the image carrier, the second guide face having flexibility, wherein the first guide face has a first base end that is fixed on an upstream side of a conveying direction of the transfer medium with respect to the transfer position, and a first leading end that extends toward the image carrier at the upstream side with respect to the transfer position, wherein the second guide face has a second base end that is fixed on the upstream side with respect to the transfer position, and a second leading end that extends from the second base end toward the image carrier at between the first leading end and the transfer position, and wherein the second guide member is disposed so that a first plane connecting the first leading end and the first base end and a second plane connecting the second leading end and the second base end cross each other at the first base end or at the upstream side with respect to the first base end.

2. The process cartridge according to claim 1, wherein at least one of the first and the second guide members is formed of a film member.

3. The process cartridge according to claim 1, wherein a geometric moment of inertia $I_1$ of the first guide member, which has a direction parallel to a longitudinal direction of the image carrier and has a direction perpendicular to a widest surface of the first guide member, is larger than a geometric moment of inertia $I_2$ of the second guide member, which has a direction parallel to the longitudinal direction of the image carrier and has a direction perpendicular to a widest surface of the second guide member.

4. The process cartridge according to claim 1, wherein a length from the first leading end to the first base end of the first guide face is longer than a length from the second leading end to the second base end of the second guide face.

5. The process cartridge according to claim 1, wherein the first guide member is formed such that a product $E_1I_1$ of Young's modulus $E_1$, which is modulus of elasticity in a direction parallel to the conveying direction, and a geometric moment of inertia $I_1$, which has a direction parallel to a longitudinal direction of the image carrier and has a direction perpendicular to a widest surface of the first guide member, is $3.49\times10^{-5}\leqq E_1I_1\leqq1.18\times10^{-3}$, and wherein the second guide member is formed such that a product $E_2I_2$ of Young's modulus $E_2$, which is modulus of elasticity in a direction parallel to the conveying direction, and a geometric moment of inertia $I_2$, which has a direction parallel to the longitudinal direction of the image carrier and has a direction perpendicular to a widest surface of the second guide member, is $3.49\times10^{-5}\leqq E_2I_{2\leqq}1.18\times10^{-3}$.

6. The process cartridge according to claim 1, wherein the first guide member is provided at a position to guide the transfer medium such that a contact angle θ between the image carrier and the transfer medium is $\theta<90°$.

7. The process cartridge according to claim 1, wherein the first and the second guide members are formed in a predetermined shape by press working by being contacted by a cutter blade at the first and the second guide faces.

8. The process cartridge according to claim 1, wherein at least one of the first and the second guide members is divided in a width direction orthogonal to the conveying direction.

9. The process cartridge according to claim 1, wherein at least one of the first and the second guide members is provided with a notch that extends toward the first base end or the second base end from an edge of the first leading end or the second leading end along the conveying direction.

10. The process cartridge according to claim 9, wherein at least one of the first and the second guide members is provided with a separation stopper disposed at an end of the first base end or the second base end of the notch, the separation stopper preventing the first or the second guide member from being separated from the notch.

11. The process cartridge according to claim 1, wherein at least one of the first and the second guide members is provided with a slit that extends toward the first base end or the second base end from an edge of the first leading end or the second leading end along the conveying direction.

12. The process cartridge according to claim 11, wherein the slit is formed in a substantially rectangular shape in plan view.

13. The process cartridge according to claim 11, wherein the slit is formed in a substantially V-lettered shape in plan view.

14. The process cartridge according to claim 13, wherein at least one of the first and the second guide members is provided with a separation stopper disposed at an end of the first base end or the second base end of the slit, the separation stopper preventing the first or the second guide member from being separated from the slit.

15. The process cartridge according to claim 11, wherein the slit is formed in a substantially U-lettered shape in plan view.

16. The process cartridge according to claim 1, further comprising a plate member that has a base end that is fixed on the upstream side with respect to the transfer position, and a leading end that extends toward the image carrier at the upstream side with respect to the transfer position, wherein the plate member is provided with a plurality of leading end pieces along a direction in parallel with a longitudinal direction of the image carrier, the leading end pieces being formed by forming a notch extending toward the base end from an edge of the leading end along the conveying direction, and wherein the leading end pieces are bent with different angles from each other on the basis of the edge of the base end of the notch as a center of bending to form the first and the second guide members.

17. The process cartridge according to claim 1, further comprising a transfer unit that contacts with the image carrier and at the transfer position.

18. The process cartridge according to claim 17, wherein the edge of the first leading end of the first guide face is disposed at an opposite side to a direction where the transfer medium guided by the first guide member presses the first guide member with respect to a line that connects a the transfer position and a contact position where a pair of resist units contact with each other, the resist units being disposed in the upstream side with respect to the first guide member and being disposed to oppose with each other.

19. The process cartridge according to claim 1, wherein the first and the second guide members are formed of an insulating material.

20. The process cartridge according to claim 1, further comprising a casing that retains the image carrier and the first and the second guide members, wherein the first and the second base ends are fixed to the case.

21. An image forming apparatus comprising:

an image carrier that carries a developer image that is transferred to a transfer medium at a transfer position;

a developing unit that carries a developer, supplies the developer to the image carrier, and forms the developer image on the image carrier;

a transfer unit that contacts with the image carrier at the transfer position, and transfers the developer image to the transfer medium;

a conveying unit that conveys the transfer medium toward the transfer position;

a first guide member that is provided with a first guide face that guides the transfer medium toward the image carrier, the first guide face having flexibility; and a second guide member that is provided with a second guide face that guides the transfer medium toward the image carrier, the second guide face having flexibility, wherein the first guide face has a first base end that is fixed on an upstream side of a conveying direction of the transfer medium with respect to the transfer position, and a first leading end that extends toward the image carrier at the upstream side with respect to the transfer position, wherein the second guide face has a second base end that is fixed on the upstream side with respect to the transfer position, and a second leading end that extends from the second base end toward the image carrier at between the first leading end and the transfer position, and wherein the second guide member is disposed so that a first plane connecting the first leading end and the first base end and a second plane connecting the second leading end and the second base end cross each other at the first base end or at the upstream side with respect to the first base end.

22. The image forming apparatus according to claim 21, wherein at least one of the first and the second guide members is formed of a film member.

23. The image forming apparatus according to claim 21, wherein a geometric moment of inertia $I_1$ of the first guide member, which has a direction parallel to a longitudinal direction of the image carrier and has a direction perpendicular to a widest surface of the first guide member, is larger than a geometric moment of inertia $I_2$ of the second guide member, which has a direction parallel to the longitudinal direction of the image carrier and has a direction perpendicular to a widest surface of the second guide member.

24. The image forming apparatus according to claim 21, wherein a length from the first leading end to the first base end of the first guide face is longer than a length from the second leading end to the second base end of the second guide face.

25. The image forming apparatus according to claim 21, wherein the first guide member is formed such that a product $E_1I_1$ of Young's modulus $E_1$, which is modulus of elasticity in a direction parallel to the conveying direction, and a geometric moment of inertia $I_1$ which has a direction parallel to a longitudinal direction of the image carrier and has a direction perpendicular to a widest surface of the first guide member, is $3.49\times10^{-5}\leqq E_1I_1\leqq1.18\times10^{-3}$, and wherein the second guide member is formed such that a product $E_2I_2$ of Young's modulus $E_2$, which is modulus of elasticity in a direction parallel to the conveying direction, and a geometric moment of inertia $I_2$, which has a direction parallel to the longitudinal direction of the image carrier and has a direction perpendicular to a widest surface of the second guide member, is $3.49\times10^{-5}\leqq E_2I_2\leqq1.18\times10^{-3}$.

26. The image forming apparatus according to claim 21, wherein the first guide member is provided at a position to guide the transfer medium such that a contact angle $\theta$ between the image carrier and the transfer medium is $\theta<90°$.

27. The image forming apparatus according to claim 21, wherein the first and the second guide members are formed in a predetermined shape by press working by being contacted by a cutter blade at the first and the second guide faces.

28. The image forming apparatus according to claim 21, wherein at least one of the first and the second guide members is divided in a width direction orthogonal to the conveying direction.

29. The image forming apparatus according to claim 21, wherein at least one of the first and the second guide members is provided with a notch that extends toward the first base end or the second base end from an edge of the first leading end or the second leading end along the conveying direction.

30. The image forming apparatus according to claim 29, wherein at least one of the first and the second guide members is provided with a separation stopper disposed at an end of the first base end or the second base end of the notch, the separation stopper preventing the first or the second guide member from being separated from the notch.

31. The image forming apparatus according to claim 21, wherein at least one of the first and the second guide members is provided with a slit that extends toward the first base end or the second base end from an edge of the first leading end or the second leading end along the conveying direction.

32. The image forming apparatus according to claim 31, wherein the slit is formed in a substantially rectangular shape in plan view.

33. The image forming apparatus according to claim 31, wherein the slit is formed in a substantially V-lettered shape in plan view.

34. The image forming apparatus according to claim 33, wherein at least one of the first and the second guide members is provided with a separation stopper disposed at an end of the first base end or the second base end of the slit, the separation stopper preventing the first or the second guide member from being separated from the slit.

35. The image forming apparatus according to claim 31, wherein the slit is formed in a substantially U-lettered shape in plan view.

36. The image forming apparatus according to claim 21, further comprising a plate member that has a base end that is fixed on the upstream side with respect to the transfer position, and a leading end that extends toward the image carrier at the upstream side with respect to the transfer position, wherein the plate member is provided with a plurality of leading end pieces along a direction in parallel with a longitudinal direction of the image carrier, the leading end pieces being formed by forming a notch extending toward the base end from an edge of the leading end along the conveying direction, and wherein the leading end pieces are bent with different angles from each other on the basis of the edge of the base end of the notch as a center of bending to form the first and the second guide members.

37. The image forming apparatus according to claim 21, wherein the edge of the first leading end of the first guide face is disposed at an opposite side to a direction where the transfer medium guided by the first guide member presses the first guide member with respect to a line that connects the transfer position and a contact position where a pair of resist units contact with each other, the resist units being disposed in the upstream side with respect to the first guide member and being disposed to oppose with each other.

38. The image forming apparatus according to claim 21, wherein the first and the second guide members are formed of an insulating material.

39. The image forming apparatus according to claim 21, further comprising a casing that retains the image carrier and the first and the second guide members, wherein the first and the second base ends are fixed to the case.

* * * * *